US011249412B2

(12) United States Patent
Kawamura et al.

(10) Patent No.: US 11,249,412 B2
(45) Date of Patent: Feb. 15, 2022

(54) TONER

(71) Applicant: CANON KABUSHIKI KAISHA, Tokyo (JP)

(72) Inventors: Masashi Kawamura, Yokohama (JP); Takayuki Toyoda, Suntou-gun (JP); Kenji Ookubo, Numazu (JP); Taku Shimoda, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/853,891

(22) Filed: Apr. 21, 2020

(65) Prior Publication Data

US 2020/0341398 A1 Oct. 29, 2020

(30) Foreign Application Priority Data

Apr. 25, 2019 (JP) ..... JP2019-083981
Mar. 16, 2020 (JP) ..... JP2020-045709

(51) Int. Cl.
*G03G 9/08* (2006.01)
*G03G 9/093* (2006.01)

(52) U.S. Cl.
CPC ..... *G03G 9/09328* (2013.01); *G03G 9/09364* (2013.01); *G03G 9/09371* (2013.01)

(58) Field of Classification Search
CPC ..... G03G 9/09328; G03G 9/09364; G03G 9/09371
USPC ..... 430/110.2
See application file for complete search history.

(56) References Cited

U.S. PATENT DOCUMENTS 7,141,342 B2 11/2006 Toyoda et al.
7,264,910 B2 9/2007 Toyoda et al.
7,288,357 B2 10/2007 Toyoda et al.
7,833,685 B2 11/2010 Tanaka et al.
(Continued)

FOREIGN PATENT DOCUMENTS

JP H09-269611 10/1997
JP 2013-120251 6/2013
(Continued)

OTHER PUBLICATIONS

U.S. Appl. No. 16/847,982, Kenji Ookubo, filed Apr. 14, 2020.
(Continued)

*Primary Examiner* — Mark A Chapman
(74) *Attorney, Agent, or Firm* — Venable LLP

(57) ABSTRACT

Toner comprising a toner particle, the toner particle includes a toner core particle and an organosilicon polymer covering the toner core particle surface, the organosilicon polymer has a structure represented by $R^4$—$SiO_{3/2}$ ($R^4$ each independently represents an alkyl group having 1 to 6 carbon atoms or a phenyl group), the toner core particle includes a resin A having a substituted or unsubstituted silyl group in a molecule thereof, a substituent of the substituted silyl group is at least one selected from the group consisting of an alkyl group having 1 or more carbon atoms, an alkoxy group having 1 or more carbon atoms, a hydroxy group, a halogen atom, and an aryl group having 6 or more carbon atoms, a content of silicon atoms in the resin A is 0.02 to 10.00% by mass, and a content of silicon atoms in the organosilicon polymer is 30 to 50% by mass.

10 Claims, 1 Drawing Sheet

(56) References Cited

U.S. PATENT DOCUMENTS

| | | | |
|---|---|---|---|
| 7,833,687 | B2 | 11/2010 | Kato et al. |
| 8,211,606 | B2 | 7/2012 | Murai et al. |
| 8,377,616 | B2 | 2/2013 | Tani et al. |
| 8,628,899 | B2 | 1/2014 | Kawamura et al. |
| 8,697,327 | B2 | 4/2014 | Shibata et al. |
| 8,815,484 | B2 | 8/2014 | Tanaka et al. |
| 8,916,319 | B2 | 12/2014 | Ikeda et al. |
| 8,940,467 | B2 | 1/2015 | Hashimoto et al. |
| 9,146,485 | B2 | 9/2015 | Tani et al. |
| 9,556,290 | B2 | 1/2017 | Nishiura et al. |
| 9,715,187 | B2 | 7/2017 | Mukumoto et al. |
| 9,829,814 | B2 | 11/2017 | Yoshida et al. |
| 9,857,711 | B2 | 1/2018 | Yoshida et al. |
| 9,880,478 | B2 | 1/2018 | Shimano et al. |
| 9,921,501 | B2 | 3/2018 | Mochizuki et al. |
| 10,054,866 | B2 | 8/2018 | Tanaka et al. |
| 10,416,582 | B2 | 9/2019 | Nakagawa et al. |
| 10,437,165 | B2 | 10/2019 | Shimano et al. |
| 10,545,420 | B2 | 1/2020 | Kinumatsu et al. |
| 2008/0299482 | A1 | 12/2008 | Kato et al. |
| 2010/0035171 | A1 | 2/2010 | Watanabe et al. |
| 2013/0149640 | A1 | 6/2013 | Ishii |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2020/0041922 | A1 | 2/2020 | Shimano et al. |

FOREIGN PATENT DOCUMENTS

| | | | | |
|---|---|---|---|---|
| JP | 2018-194837 | | 12/2018 | |
| WO | WO-2009037459 | A1 * | 3/2009 | ..... G03G 9/0804 |

OTHER PUBLICATIONS

U.S. Appl. No. 16/853,894, Taku Shimoda, filed Apr. 21, 2020.

Nishikubo, "Addition Reaction of Epoxy Compounds with Esters and Its Application for Polymer Syntheses", Journal of Synthetic Organic Chemistry, vol. 49, No. 3 (1991) 218-33 (English translation of "an insertion reaction of an epoxy compound into an ester bond in a polymer chain", p. 227, left column, line 8 to p. 229, left column, line 18).

* cited by examiner

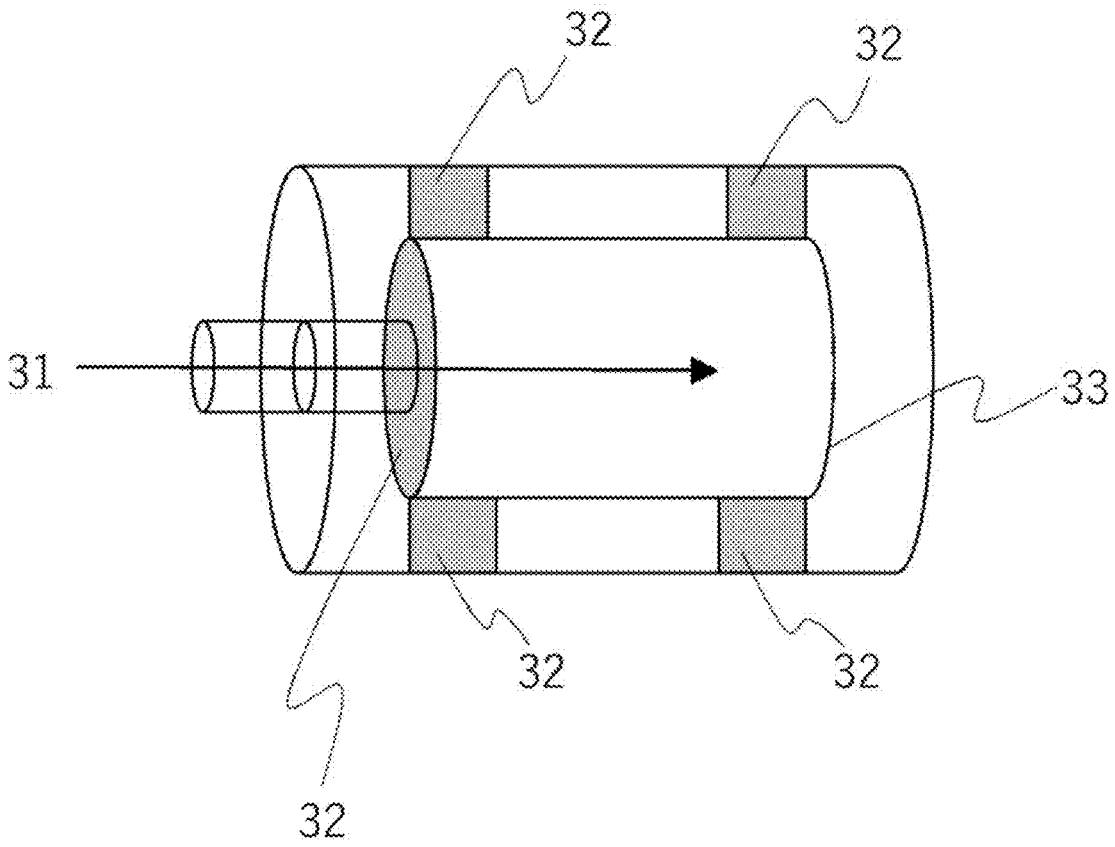
32
32
31
33
32
32
32

TONER

BACKGROUND OF THE INVENTION

Field of the Invention

The present disclosure relates to a toner for developing an electrostatic image (electrostatic latent image) used in an image forming method such as electrophotography and electrostatic printing.

Description of the Related Art

Electrophotography is a printing method including the following process, to give a general example.

First, a photosensitive member using a photoconductive substance is uniformly charged, and an electrostatic latent image is formed by exposure. Next, a toner charged by friction with a charging member such as a blade carrier or the like is developed on the photosensitive member. Finally, after a toner image is transferred to a medium such as paper or the like, the toner image is fixed on the medium by heating, pressing or the like. If necessary, the toner remaining on the photosensitive member after the transfer is removed by a cleaning member. By going through this sequence of steps again, printing can be performed continuously.

In the above process, toner is involved in almost all steps. For this reason, various characteristics of the toner, such as flowability, charging performance, and thermophysical properties (heat-resistant storage stability and fixability) need to be improved. Above all, control of the toner charging characteristics is important for obtaining a printed matter having good image quality. Specifically, the toner charging characteristics are quickness of charging by friction (charge rising performance), the magnitude of charge quantity generated by friction, and stability against temperature and humidity. Among such charging characteristics, improvement of the charge quantity of the toner is important for establishing the electrophotographic process.

In order to improve the charge quantity of the toner, an external additive (inorganic particles such as silica, titania, alumina and the like) is often attached or affixed to a toner particle surface.

However, the external additive easily contaminates parts in the developing tank and is difficult to use. Furthermore, in recent years, machine speed and longevity of machines have been improved, and it has become even more difficult to achieve both improvement of the charge quantity and prevention of contamination of parts. Under such circumstances, it is desirable to establish a technique capable of both improving the charge quantity of toner and preventing the contamination of parts.

A technique that does not use external additives has been developed as an example of a method for solving these problems. Specifically, a method for coating an alkoxysilane polymer on the toner particle surface by using a sol-gel process is known.

Japanese Patent Application Publication No. 2013-120251 discloses a toner in which the toner particle surface is coated with a tetraalkoxysilane polymer in order to solve the conventional problem of detachment or embedding of an external additive.

Japanese Patent Application Publication No. H09-269611 discloses a toner in which the surface of a toner core particle composed of a polyvinyl-based thermoplastic resin having a dialkoxysilyl group is coated with a dialkoxysilane polymer in order to prevent hot offset in the toner fixing process.

Japanese Patent Application Publication No. 2018-194837 discloses a toner in which the toner particle surface is coated with a trialkoxysilane polymer as a main component in order to improve the resistance to abrasion caused by a developing unit.

SUMMARY OF THE INVENTION

It has been found that the method described in Japanese Patent Application Publication No. 2013-120251 has an insufficient charge quantity. This is considered to be due to charge leakage occurring on the toner surface. This will be specifically described hereinbelow.

The coating layer on the toner particle surface in the method described in Japanese Patent Application Publication No. 2013-120251 mainly includes silicon dioxide. However, depending on conditions, the polymerization of the tetraalkoxysilane may be insufficient for complete conversion into silicon dioxide, and a large number of silanol groups may be present. The charge leakage is considered to be due to a high hygroscopicity of silanol groups that lowers the resistance value of the toner.

Further, it has been found that the method described in Japanese Patent Application Publication No. 2013-120251 is also insufficient in preventing the contamination of parts. It is considered that the reason for this is that the coating layer becomes brittle because the proportion of complete conversion into silicon dioxide is small and a crosslinked network of siloxane bonds is small as described above.

It has been further found that the method described in Japanese Patent Application Publication No. H09-269611 also has an insufficient charge quantity of the toner. This is also considered to be due to charge leakage occurring on the toner surface. This will be specifically described hereinbelow.

The coating layer on the toner particle surface in the method described in Japanese Patent Application Publication No. H09-269611 mainly includes a polydimethylsilicone compound. Since the polydimethylsilicone compound has high flexibility, the generated charges are presumably difficult to hold in place. As a result, it is considered that charge leakage has occurred.

Also, it has been found that the method described in Japanese Patent Application Publication No. H09-269611 was insufficient in preventing the contamination of parts. It is considered that the reason for this is that there are many free components, and the free components easily adhere to the parts.

The details are explained hereinbelow. Japanese Patent Application Publication No. H09-269611 discloses that polydimethylsilicone is covalently bonded by a resin including bifunctional silane contained in a toner particle, but the proportion of the polydimethylsilicone covalently bonded to the toner particle surface is small. Therefore, it is considered that the number of free components increases, and the free components easily adhere to the parts.

It has been found that the method described in Japanese Patent Application Publication No. 2018-194837 has a higher toner charge quantity than the methods described in Japanese Patent Application Publication Nos. 2013-120251 and H09-269611. It is considered that the reason therefor is that charge leakage occurring on the toner surface as described above was prevented. This will be specifically described hereinbelow.

The trialkoxysilane polymer, which is the main component of the toner particle coating layer described in Japanese Patent Application Publication No. 2018-194837, has higher hydrophobicity than tetraalkoxysilane polymer and is harder than the polydimethylsilicone polymer. This is apparently why the charge leakage as described above is prevented.

However, it has been found that, in a higher-speed process, the charge quantity is insufficient even if the charge leakage occurring on the toner surface can be prevented.

In addition, it has been found that the method described in Japanese Patent Application Publication No. 2018-194837 prevents the contamination of parts as compared with the methods described in Japanese Patent Application Publication Nos. 2013-120251 and H09-269611. It is considered that the reason therefor is that wear resistance was enhanced by using an organosilicon polymer having a predetermined Martens hardness.

However, it has been found that the charge quantity is insufficient for the aforementioned reason. Therefore, in order to ensure a sufficient charge quantity, the use of an external additive such as hydrotalcite particles or the like was investigated, but it was difficult to prevent the contamination of parts by the external additive.

As described above, there is a trade-off relationship between the improvement of the toner charging performance and the prevention of contamination of parts, and it has been difficult to solve the problems with the related art.

The present disclosure provides a toner that solves the problems of the related art. That is, the present disclosure provides a toner that can achieve both the improvement of the charge quantity of the toner and the prevention of contamination of parts.

The present disclosure is a toner comprising a toner particle, wherein the toner particle includes a toner core particle; and an organosilicon polymer that covers a surface of the toner core particle, the organosilicon polymer has a structure represented by a following formula (A), $$R^4—SiO_{3/2} \quad (A)$$

where, $R^4$ each independently represents an alkyl group having 1 to 6 carbon atoms or a phenyl group, the toner core particle includes a resin A, the resin A has a substituted or unsubstituted silyl group in a molecule thereof, a substituent of the substituted silyl group is at least one selected from the group consisting of an alkyl group having 1 or more carbon atoms, an alkoxy group having 1 or more carbon atoms, a hydroxy group, a halogen atom, and an aryl group having 6 or more carbon atoms, a content of silicon atoms in the resin A is from 0.02% by mass to 10.00% by mass, and a content of silicon atoms in the organosilicon polymer is from 30% by mass to 50% by mass.

According to the present disclosure, a toner that can achieve both the improvement of the charge quantity of the toner and the prevention of contamination of parts can be provided.

Further features of the present invention will become apparent from the following description of exemplary embodiments with reference to the attached drawings.

BRIEF DESCRIPTION OF THE DRAWINGS

The FIGURE is a schematic view of a Faraday cage.

DESCRIPTION OF THE EMBODIMENTS

The description of "from XX to YY" and "XX to YY" representing a numerical range means a numerical range including a lower limit and an upper limit which are endpoints unless otherwise specified.

The inventors of the present disclosure have conducted intensive studies to solve the above-mentioned problems of the related art, and as a result, have found that by adopting the following features, it is possible to achieve both the improvement of the charge quantity of toner and the prevention of contamination of parts.

Specifically, the toner is a toner comprising a toner particle, wherein the toner particle includes a toner core particle; and an organosilicon polymer that covers a surface of the toner core particle, the organosilicon polymer has a structure represented by a following formula (A), the toner core particle includes a resin A, $$R^4—SiO_{3/2} \quad (A)$$

where, $R^4$ each independently represents an alkyl group having 1 to 6 carbon atoms or a phenyl group, the resin A has a substituted or unsubstituted silyl group in a molecule thereof, a substituent of the substituted silyl group is at least one selected from the group consisting of an alkyl group having 1 or more carbon atoms, an alkoxy group having 1 or more carbon atoms, a hydroxy group, a halogen atom, and an aryl group having 6 or more carbon atoms, a content of silicon atoms in the resin A is from 0.02% by mass to 10.00% by mass, and a content of silicon atoms in the organosilicon polymer is from 30% by mass to 50% by mass.

The inventors suppose that the following mechanism greatly increases, as compared with the conventional toner, the charge quantity and can prevent the contamination of parts.

First, the mechanism for improving the charge quantity will be described.

Toner charging is a phenomenon in which an electric charge is applied to the toner surface by friction between the toner surface and a charging member such as a charging roller, a charging blade, and a carrier. At this time, where the electric resistance of the toner surface is high, the electric charge is maintained on the toner surface, so that the toner can be charged. However, the charge can be applied only to the rubbed portion, so that the charge quantity is low.

Meanwhile, when the electric resistance of the toner surface is low, a phenomenon (charge leakage) occurs in which electric charges run off the toner surface and escape. As a result, the charge quantity decreases.

Specifically, the conventional toners described in Japanese Patent Application Publication Nos. 2013-120251 and H09-269611 have a low charge quantity due to a large charge leakage on the toner surface.

By contrast, the conventional toner described in Japanese Patent Application Publication No. 2018-194837 has a small charge leakage on the toner surface, and the charge quantity is improved albeit not sufficiently. However, since the generated charges are retained on the toner surface and the charges on the toner surface are immediately saturated, the charge quantity is insufficient in a high-speed process.

Thus, with the conventional toner, a high charge quantity could not be achieved due to the relationship between triboelectric charging and charge leakage on the toner surface.

Meanwhile, in the toner of the present disclosure, it is considered that a high charge quantity can be realized because the charge on the toner surface is diffused into the toner core particle, and the entire toner particle can be charged.

Diffusion of charges into the toner core particle is caused by the resin A in the toner core particle.

Specifically, the silyl group in the resin A is easily negatively charged. Meanwhile, segments other than the silyl group in the resin A tend to be positively charged. Therefore, charge transfer occurs between the structure represented by the formula (A) and contained in the organosilicon polymer covering the surface of the toner core particle and the silyl group of the resin A inside the toner core particle. As a result, electric charge propagates from the toner surface to the inside of the toner core.

The propagation of the charge reduces the charge on the toner surface, so that the toner surface can be further charged by friction, and as a result, the toner can be highly charged.

Next, the mechanism for preventing the contamination of parts will be described.

Although the coating of the organosilicon polymer in the toner described in Japanese Patent Application Publication No. 2018-194837 is hard and has high abrasion resistance, it was found that the coating has insufficient adhesion to the toner core particle, and may contaminate parts when printing a large number of prints.

By contrast, in the present disclosure, by causing the resin A to be present in the toner core particle, the contamination of parts can be prevented. The present inventors believe that this is because the polarity of the resin A in the toner core particle and the polarity of the organosilicon polymer are close to each other, so that the adhesion between the toner core particle and the organosilicon polymer is improved.

As described hereinabove, by coating the toner core particle including the resin A with the organosilicon polymer having the structure represented by the formula (A), it is possible for the first time to achieve both the improvement of the charge quantity and the prevention of contamination of parts which has been the conventional problem.

Hereinafter, the features and factors of the present disclosure will be described in detail.

<Resin A>

The toner core particle includes the resin A. The resin A has (i) a substituted or unsubstituted silyl group in the molecule thereof, and (ii) a substituent of the substituted silyl group is at least one selected from the group consisting of an alkyl group having 1 or more carbon atoms, an alkoxy group having 1 or more carbon atoms, a hydroxy group, a halogen atom, and an aryl group having 6 or more carbon atoms.

The number of carbon atoms in the alkyl group is preferably from 1 to 20, and more preferably from 1 to 4.

The number of carbon atoms in the alkoxy group is preferably from 1 to 20, more preferably from 1 to 4, further preferably from 1 to 3, and particularly preferably 1 or 2.

The number of carbon atoms in the aryl group is preferably from 6 to 14, and more preferably from 6 to 10.

The resin A is not limited as long as the above conditions (i) and (ii) are satisfied. Examples of the resin A include a resin with a chemically bonded silane coupling agent or the like, a polymer of an organosilicon compound, and a hybrid resin thereof. More specific examples include resins obtained by modifying a polyester resin, a vinyl resin, a polycarbonate resin, a polyurethane resin, a phenol resin, an epoxy resin, a polyolefin resin, or a styrene acrylic resin with a silane coupling agent and/or a silicone oil or the like.

The content of silicon atoms in the resin A is from 0.02% by mass to 10.00% by mass. Within this range, the adhesion between the toner core particle and the organosilicon polymer can be improved while electric charges are propagated inside the toner core, so that both the improvement in the charge quantity and the prevention of contamination of the part can be achieved.

The content of silicon atoms in the resin A is preferably from 0.10% by mass to 5.00% by mass, and more preferably from 0.15% by mass to 2.00% by mass.

The content of silicon atoms in the resin A can be controlled by adjusting the amount of the silicon compound used in the production of the resin A.

Further, the content of the resin A in the toner core particle is preferably from 0.1% by mass to 100.0% by mass, and more preferably from 0.3% by mass to 30.0% by mass.

The resin A preferably has a structure represented by the following formula (1).

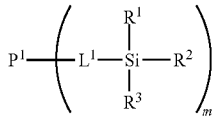

(1)

Where, $P^1$ represents a polymer segment, $L^1$ represents a single bond or a divalent linking group, and $R^1$ to $R^3$ each independently represent a hydrogen atom, a halogen atom, an alkyl group having 1 or more carbon atoms, an alkoxy group having 1 or more carbon atoms, an aryl group having 6 or more carbon atoms, or a hydroxy group, m represents a positive integer, and when m is 2 or more, a plurality of $L^1$, a plurality of $R^1$, a plurality of $R^2$ and a plurality of $R^3$ may each be the same or different.

At least one of $R^1$ to $R^3$ in the formula (1) preferably represents an alkoxy group having 1 or more carbon atoms or a hydroxy group. More preferably, $R^1$ to $R^3$ in the formula (1) each independently represent an alkoxy group having 1 or more carbon atoms or a hydroxy group.

Of the above substituents, the alkyl group preferably has from 1 to 20 carbon atoms, and more preferably from 1 to 4 carbon atoms. The number of carbon atoms in the alkoxy group is preferably from 1 to 20, more preferably from 1 to 4, further preferably from 1 to 3, and particularly preferably 1 or 2. Further, the number of carbon atoms in the aryl group is preferably from 6 to 14, and more preferably from 6 to 10.

When at least one of $R^1$ to $R^3$ in the formula (1) represents an alkoxy group having 1 or more carbon atoms or a hydroxy group, the structure represented by the formula (1) has a Si—O— bond.

The toner core particle having Si—O— bond has an increased affinity for Si—O— bonds in the organosilicon polymer on the toner particle surface. As a result, the efficiency of charge propagation to the inside of the toner core is improved, the charge quantity is further improved, and the adhesion between the toner core particle and the organosilicon polymer is further improved.

Further, by improving the adhesion between the toner core particle and the organosilicon polymer, the resistance to thermal deformation is increased, and the heat-resistant storage stability of the toner is also improved.

In order to convert one or more of $R^1$ to $R^3$ in the formula (1) into a hydroxy group, the resin A in which one or more of $R^1$ to $R^3$ is an alkoxy group may be hydrolyzed to convert the alkoxy group into a hydroxy group.

Any hydrolysis method may be used and an example thereof is described hereinbelow.

The resin A in which at least one of $R^1$ to $R^3$ in the formula (1) is an alkoxy group is dissolved or suspended in a suitable solvent (which may be a polymerizable monomer), and the pH is adjusted to an acidic value with an acid or an alkali, followed by hydrolysis.

Also, hydrolysis may be caused during the production of the toner particle.

$P^1$ in the formula (1) is not particularly limited, and examples thereof include a polyester segment, a vinyl segment, a styrene acrylic segment, a polyurethane segment, a polycarbonate segment, a phenolic resin segment, a polyolefin segment, and the like.

Among these, from the viewpoint of charge rising performance, it is preferable that $P^1$ include a polyester segment or a styrene acrylic segment. For example, a hybrid segment of polyester and styrene acrylic may be used. More preferably, $P^1$ represents a polyester segment or a styrene acrylic segment, and particularly preferably a polyester segment.

The reason therefor is considered hereinbelow. Since charge transfer occurs between the silicon atom in the resin represented by the formula (1) and the ester bond in $P^1$, the charge triboelectrically generated on the toner surface is diffused throughout the toner. Due to this diffusion, not only the surface of the toner but also the inside of the toner can contribute to the charging, so that the charge rising performance is improved.

From the viewpoints of charge rising performance and storage stability, the weight average molecular weight (Mw) of the resin A is preferably from 3,000 to 100,000, and more preferably from 3,000 to 30,000. The Mw of the resin A can be controlled by various methods depending on the type of the contained resin. For example, when a polyester resin is contained, the control can be performed by adjusting the charge ratio of a dialcohol and a dicarboxylic acid, which are monomers thereof, or adjusting the polymerization time. Where a styrene acrylic resin is contained, the control can be performed by adjusting the ratio of the vinyl monomer, which is the monomer thereof, to the polymerization initiator, or adjusting the reaction temperature.

The polyester resin is not particularly limited, but is preferably a condensate of a dialcohol and a dicarboxylic acid. For example, a polyester resin having a structure represented by the following formula (6) and at least one structure (a plurality of structures can be selected) selected from the group consisting of structures represented by the following formulas (7) to (9) is preferred. Another example is a polyester resin having a structure represented by the following formula (10).

(6)

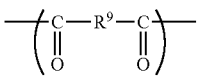

(7)

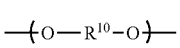

-continued (8)

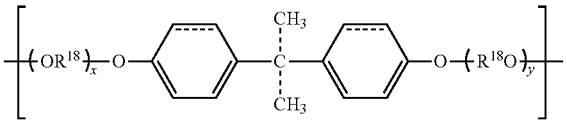

(9)

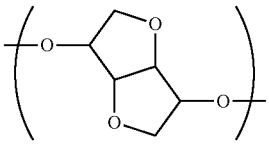

(10)

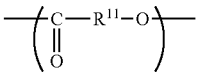

Where, $R^9$ represents an alkylene group, an alkenylene group, or an arylene group; $R^{10}$ represents an alkylene group or a phenylene group; $R^{18}$ represents an ethylene group or a propylene group, x and y are each an integer of 0 or more, and the average value of x+y is from 2 to 10; $R^{11}$ represents an alkylene group or an alkenylene group.

Examples of the alkylene group (preferably having from 1 to 12 carbon atoms) for $R^9$ in the formula (6) include a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, and 1,3-cyclopentylene, 1,3-cyclohexylene, and 1,4-cyclohexylene groups.

Examples of the alkenylene group (preferably having from 1 to 4 carbon atoms) for $R^9$ in the formula (6) include a vinylene group, a propenylene group and a 2-butenylene group.

Examples of the arylene group (preferably having from 6 to 12 carbon atoms) for $R^9$ in the formula (6) include a 1,4-phenylene group, a 1,3-phenylene group, a 1,2-phenylene group, a 2,6-naphthylene group, a 2,7-naphthylene group and a 4,4'-biphenylene group.

$R^9$ in the formula (6) may be substituted with a substituent. In this case, examples of the substituent include a methyl group, a halogen atom, a carboxy group, a trifluoromethyl group, and a combination thereof.

Examples of the alkylene group (preferably having from 1 to 12 carbon atoms) for $R^{10}$ in the formula (7) include a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, and 1,3-cyclopentylene, 1,3-cyclohexylene, and 1,4-cyclohexylene groups.

Examples of the phenylene group for $R^{10}$ in the formula (7) include a 1,4-phenylene group, a 1,3-phenylene group, and a 1,2-phenylene group.

$R^{10}$ in the formula (7) may be substituted with a substituent. In this case, examples of the substituent include a methyl group, an alkoxy group, a hydroxy group, a halogen atom, and a combination thereof.

Examples of the alkylene group (preferably having from 1 to 12 carbon atoms) for $R^{11}$ in the formula (10) include a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, and a 1,4-cyclohexylene group.

Examples of the alkenylene group (preferably having from 1 to 40 carbon atoms) for in the formula (10) include a vinylene group, a propenylene group, a butenylene group, a butadienylene group, a pentenylene group, a hexenylene group, a hexadienylene group, a heptenylene group, an octanylene group, a decenylene group, an octadecenylene group, an eicosenylene group, and a triacontenylene group. These alkenylene groups may have any of a linear, branched and cyclic structure. Further, the double bond may be at any position, as long as there is at least one double bond.

$R^{11}$ in the formula (10) may be substituted with a substituent. In this case, examples of the substituent that may be used for substitution include an alkyl group, an alkoxy group, a hydroxy group, a halogen atom, and a combination thereof.

The vinyl resin is not particularly limited, and a known resin can be used. For example, the following monomers can be used.

Styrene-based monomers such as styrene and derivatives thereof such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene.

Acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

Methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

Amino group-containing α-methylene aliphatic monocarboxylic acid esters such as dimethylaminoethyl methacrylate and diethylaminoethyl methacrylate; and vinyl monomers including a nitrogen atom such as acrylic acid or methacrylic acid derivatives such as acrylonitrile, methacrylonitrile and acrylamide.

Unsaturated dibasic acids such as maleic acid, citraconic acid, itaconic acid, alkenylsuccinic acid, fumaric acid, and mesaconic acid; α, β-unsaturated acids such as acrylic acid, methacrylic acid, crotonic acid, cinnamic acid; vinyl monomers including a carboxy group such as acid anhydrides of these acids.

When a compound including a carboxy group includes a vinyl resin, a method for including a carboxy group in the vinyl resin is not particularly limited, and a known method can be used. For example, it is preferable to use a vinyl-based monomer including a carboxy group such as acrylic acid and methacrylic acid.

The vinyl resin is preferably a polymer of at least one selected from the group consisting of acrylic acid esters and methacrylic acid esters, a styrene-based monomer and a vinyl-based monomer including a carboxy group.

Examples of the divalent linking group represented by $L^1$ in the formula (1) include, but are not limited to, structures represented by the following formulas (2) to (5).

(2)

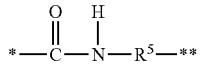

(3)

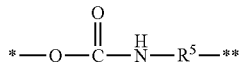

(4)

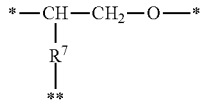

(5)

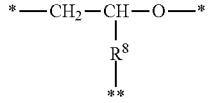

$R^5$ in the formula (2) represents a single bond, an alkylene group or an arylene group. (*) represents a binding segment to $P^1$ in the formula (1), and (**) represents a binding segment to a silicon atom in the formula (1). $R^6$ in the formula (3) represents a single bond, an alkylene group or an arylene group. (*) represents a binding segment to $P^1$ in the formula (1), and (**) represents a binding segment to a silicon atom in the formula (1). $R^7$ and $R^8$ in the formulas (4) and (5) each independently represent an alkylene group, an arylene group, or an oxyalkylene group. (*) represents a binding segment to $P^1$ in the formula (1), and (**) represents a binding segment to a silicon atom in the formula (1).

The structure represented by the formula (2) is a divalent linking group including an amide bond.

The linking group can be formed, for example, by reacting a carboxy group in the resin with an aminosilane.

The aminosilane is not particularly limited, and examples thereof include γ-aminopropyltriethoxysilane, γ-aminopropyltrimethoxysilane, N-β-(aminoethyl) γ-aminopropyltrimethoxysilane, N-β-(aminoethyl) γ-aminopropylmethyldimethoxysilane, N-phenyl γ-aminopropyltriethoxysilane, N-phenyl γ-aminopropyltrimethoxysilane, N-β-(aminoethyl) γ-aminopropyltriethoxysilane, N-6-(aminohexyl) 3-aminopropyltrimethoxysilane, 3-aminopropyltrimethylsilane, 3-aminopropylsilicon and the like.

The alkylene group (preferably having from 1 to 12 carbon atoms) in $R^5$ is not particularly limited, and may be, for example, an alkylene group including an —NH— group.

The arylene group (preferably having from 6 to 12 carbon atoms) in $R^5$ is not particularly limited, and may be, for example, an arylene group including a hetero atom.

The structure represented by the formula (3) is a divalent linking group including a urethane bond.

The linking group can be formed, for example, by reacting a hydroxy group in the resin with an isocyanate silane.

The isocyanate silane is not particularly limited, and examples thereof include 3-isocyanatopropyltrimethoxysilane, 3-isocyanatopropylmethyldimethoxysilane, 3-isocyanatopropyldimethylmethoxysilane, 3-isocyanatopropyltriethoxysilane, 3-isocyanatopropylmethyldiethoxysilane, 3-isocyanatopropyldimethylethoxysilane and the like.

The alkylene group (preferably having from 1 to 12 carbon atoms) in $R^6$ is not particularly limited, and may be, for example, an alkylene group including an —NH— group.

The arylene group (preferably having from 6 to 12 carbon atoms) in $R^6$ is not particularly limited, and may be, for example, an arylene group including a hetero atom.

The structure represented by the formula (4) or (5) is a divalent linking group including a bond grafted to an ester bond in the resin.

The linking group is formed by, for example, an epoxysilane insertion reaction.

The term "epoxysilane insertion reaction" refers to a reaction including a step of causing an insertion reaction of an epoxy group of epoxysilane into an ester bond contained in a main chain in a resin. Further, the term "insertion reaction" as used herein is described in "Journal of Synthetic Organic Chemistry, Japan", Vol. 49, No. 3, p. 218, 1991, as "an insertion reaction of an epoxy compound into an ester bond in a polymer chain".

The reaction mechanism of the epoxysilane insertion reaction can be represented by the following model diagram.

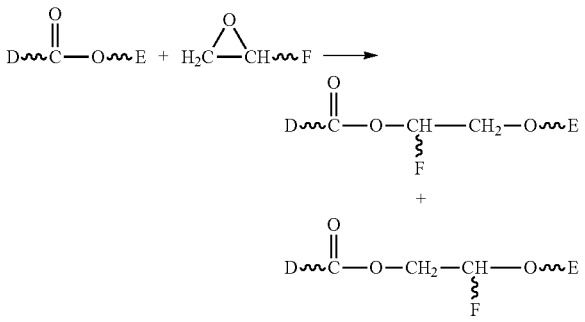

In the above diagram, D and E indicate the constituent parts of the resin, and F indicates the constituent part of the epoxy compound.

Two kinds of compounds are formed due to α-cleavage and β-cleavage in the ring opening of the epoxy group in the diagram. In both cases, a compound is obtained in which an epoxy group is inserted into an ester bond in a resin, in other words, a compound in which a constituent part of the epoxy compound other than the epoxy segment is grafted to the resin.

The epoxysilane is not particularly limited, and may be, for example, β-(3,4-epoxycyclohexyl)ethyltrimethoxysilane, γ-glycidoxypropyltrimethoxysilane, γ-glycidoxypropylmethyldiethoxysilane and the like.

The alkylene group (preferably having from 1 to 12 carbon atoms) in $R^7$ and $R^8$ is not particularly limited, and may be, for example, an alkylene group including an —NH— group.

The arylene group (preferably having from 6 to 12 carbon atoms) in $R^7$ and $R^8$ is not particularly limited, and may be, for example, an arylene group including a hetero atom.

The oxyalkylene group (preferably having from 1 to 12 carbon atoms) in $R^7$ and $R^8$ is not particularly limited, and may be, for example, an oxyalkylene group including an —NH— group.

<Organosilicon Polymer Having Structure Represented by Formula (A)>

The organosilicon polymer has at least a structure represented by the following formula (A).

$$R^4—SiO_{3/2} \quad (A)$$

Where, $R^4$ each independently represents an alkyl group having from 1 to 6 carbon atoms (preferably from 1 to 3 carbon atoms) or a phenyl group.

Of the four valence electrons of the Si atom in the structure represented by the formula (A), one is involved in bonding to $R^4$, and the remaining three are involved in bonding to the O atom. The O atom forms a state in which two valences are both bonded to Si, that is, a siloxane bond (Si—O—Si). Considering Si atoms and O atoms as those of an organosilicon polymer, since there are three O atoms for two Si atoms, the representation is $—SiO_{3/2}$.

The organosilicon polymer having the structure represented by the formula (A) has high hardness because the concentration of siloxane bonds contained in the structure is close to that of silicon dioxide ($SiO_2$). In addition, since $R^4$ is bonded, the structure has strong hydrophobicity. For these reasons, charge leakage on the toner surface can be prevented, and thus the toner of the present disclosure has a higher charge quantity than conventional toners.

The composition of the organosilicon polymer having the structure represented by the formula (A) may be controlled so that the hardness and hydrophobicity of the organosilicon polymer fall within desired ranges. Specifically, the control may be performed by changing the type and amount of the organosilicon compound used for the production of the organosilicon polymer, and the reaction temperature, reaction time, reaction solvent and pH of hydrolysis, addition polymerization and condensation polymerization during formation of the organosilicon polymer.

The content of silicon atoms in the organosilicon polymer thus obtained is from 30% by mass to 50% by mass, and preferably from 33% by mass to 40% by mass. The content of silicon atoms in the organosilicon polymer can be controlled by a method for performing polycondensation by changing the type of the organosilicon compound at the time of production, polycondensation of a mixture of different types of organosilicon polymers adjusted in mixing ratio, or polycondensation after adjusting (or while adjusting) the temperature or pH.

Further, in $^{29}$Si-NMR measurement of a tetrahydrofuran-insoluble matter of the toner particle, the proportion of the peak area of the structure represented by the formula (A) to the total peak area of the organosilicon polymer is preferably from 30% to 100%. Furthermore, in order to greatly improve the charge quantity and the prevention of the contamination of parts, the proportion of the peak area of the structure represented by the formula (A) is more preferably from 50% to 100%, and even more preferably from 50% to 90%. The proportion of the peak area of the structure represented by the formula (A) can be controlled by a method for performing polycondensation by changing the type of the organosilicon compound at the time of production, polycondensation of a mixture of different types of organosilicon polymers adjusted in mixing ratio, or polycondensation after adjusting (or while adjusting) the temperature or pH.

In the organosilicon polymer having the structure represented by the formula (A), from the viewpoint of setting the hardness and hydrophobicity of the organosilicon polymer within suitable ranges, $R^4$ in the formula (A) is preferably an alkyl group having from 1 to 6 carbon atoms or a phenyl group, and $R^4$ is more preferably a hydrocarbon group having from 1 to 3 carbon atoms. From the viewpoint of charge retention property, $R^4$ is more preferably a methyl group or an ethyl group, and particularly preferably a methyl group.

<Method for Producing Organosilicon Polymer Having Structure Represented by Formula (A)>

The organosilicon polymer is not particularly limited, but is preferably a condensation polymer of an organosilicon compound (trifunctional silane) having a structure represented by a following formula (11).

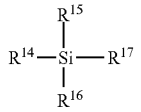

(11)

Where, $R^{14}$ has the same meaning as $R^4$ in the formula (A).

Where, $R^{15}$ to $R^{17}$ each independently represent a halogen atom, a hydroxy group, an acetoxy group, or an alkoxy group (hereinafter, these are collectively referred to as reactive groups). These reactive groups undergo hydrolysis, addition polymerization and polycondensation to form a crosslinked structure, whereby the contamination of parts can be further prevented.

From the viewpoint of mild hydrolysis at room temperature and precipitation property and coatability on the toner particle surface, $R^{15}$ to $R^{17}$ are preferably each independently an alkoxy group having from 1 to 3 carbon atoms, and more preferably a methoxy group or an ethoxy group. The hydrolysis, addition polymerization and polycondensation of $R^{15}$ to $R^{17}$ can be controlled by changing the reaction temperature, reaction time, reaction solvent and pH.

In order to obtain the organosilicon polymer, trifunctional silanes may be used alone or in combination of a plurality thereof.

Specific examples of the trifunctional silanes are listed hereinbelow.

Trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane.

Trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, butyltrihydroxysilane, hexyltrimethoxysilane, hexyltriethoxysilane, hexyltrichlorosilane, hexyltriacetoxysilane, and hexyltrihydroxysilane.

Trifunctional phenylsilanes such as phenyltrimethoxysilane, phenyltriethoxysilane, phenyltrichlorosilane, phenyltriacetoxysilane, and phenyltrihydroxysilane.

In addition, an organosilicon polymer obtained by using the following compounds in combination with the trifunctional silane may be used to the extent that the effects of the present disclosure are not impaired.

An organosilicon compound with four reactive groups in one molecule (tetrafunctional silane), an organosilicon compound with two reactive groups in one molecule (difunctional silane), an organosilicon compound with one reactive group in one molecule (monofunctional silane), and the abovementioned trifunctional silanes in which $R^4$ has a substituent. Specific examples of these compounds are listed hereinbelow.

Dimethyldimethoxysilane, dimethyldiethoxysilane, tetramethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, 3-(2-aminoethyl)aminopropyltriethoxysilane.

Trifunctional vinylsilanes such as vinyltriisocyanatesilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

Further, the content of the organosilicon polymer in the toner particle is preferably from 0.1% by mass to 20.0% by mass, and more preferably from 1.0% by mass to 10.0% by mass.

Where the content of the organosilicon polymer is 0.1% by mass or more, the occurrence of contamination of parts and fogging can be prevented. Where the amount is 20.0% by mass or less, charge-up can be made less likely to occur. The content of the organosilicon polymer can be controlled by changing the type and amount of the organosilicon compound used in the production of the organosilicon polymer, the method for producing the toner particle when forming the organosilicon polymer, and also the reaction temperature, reaction time, reaction solvent and pH.

A method for producing the organosilicon polymer is exemplified by the following method, but is not limited thereto.

First, core particles of a toner including a binder resin and, if necessary, a colorant are produced and dispersed in an aqueous medium to obtain a core particle-dispersed solution. Next, an organosilicon compound is added to the core particle-dispersed solution and subjected to polycondensation to form an organosilicon polymer covering the surface of the toner core particles.

As an addition method for the organosilicon compound, the organosilicon compound may be added as it is. Alternatively, it may be added after being mixed with an aqueous medium and hydrolyzed in advance.

The organosilicon compound undergoes the polycondensation reaction after hydrolysis. The pH optimum for the hydrolysis reaction may be different from the pH optimum for the polycondensation reaction. For this reason, the reaction can be effectively advanced by mixing the organosilicon compound and the aqueous medium in advance, hydrolyzing the mixture at a pH suitable for the hydrolysis reaction, and hen performing polycondensation of the organosilicon compound at the pH optimal for the polycondensation reaction.

<Binder Resin>

The resin contained in the toner core particle may be the resin A alone, or may include a binder resin if necessary.

When the toner core particle includes a binder resin, the content of the resin A is preferably from 0.1 parts by mass to 20.0 parts by mass, and more preferably from 0.3 parts by mass to 5.0 parts by mass with respect to 100 parts by mass of the binder resin.

The binder resin is not particularly limited, and a conventionally known binder resin can be used. For example, a vinyl resin, a polyester resin and the like are preferable. The following resins and polymers can be exemplified as the vinyl resin, polyester resin and other binder resin.

Homopolymers of styrene and substituted products thereof such as polystyrene and polyvinyltoluene;

styrene-based copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer;

polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resin, phenolic resins, aliphatic or alicyclic hydrocarbon resins and aromatic petroleum resins.

These binder resins can be used alone or as a mixture of a plurality thereof.

From the viewpoint of charging performance, the binder resin preferably includes a carboxy group, and is preferably a resin produced using a polymerizable monomer including a carboxy group. Specific examples of the polymerizable monomer including a carboxy group include, for example, the following polymerizable monomers, but are not limited thereto.

(Meth)acrylic acid α-alkyl derivatives or β-alkyl derivatives such as α-ethylacrylic acid and crotonic acid; unsaturated dicarboxylic acids such as fumaric acid, maleic acid, citraconic acid, and itaconic acid; and unsaturated dicarboxylic acid monoester derivatives such as monoacryloyloxyethyl succinate, monomethacryloyloxyethyl succinate, monoacryloyloxyethyl phthalate, and monomethacryloyloxyethyl phthalate.

As the polyester resin, those obtained by polycondensation of a carboxylic acid component and an alcohol component listed hereinbelow can be used.

Examples of the carboxylic acid component include terephthalic acid, isophthalic acid, phthalic acid, fumaric acid, maleic acid, cyclohexanedicarboxylic acid, and trimellitic acid.

Examples of the alcohol component include bisphenol A, hydrogenated bisphenol, ethylene oxide adduct of bisphenol A, propylene oxide adduct of bisphenol A, glycerin, trimethylolpropane, and pentaerythritol.

Further, the polyester resin may be a polyester resin including a urea group. It is preferable that the carboxy group present at the polyester resin terminal or the like be not capped.

The binder resin may have a polymerizable functional group for the purpose of improving the viscosity change of the toner at a high temperature. Examples of the polymerizable functional group include a vinyl group, an isocyanate group, an epoxy group, an amino group, a carboxy group, and a hydroxy group.

<Crosslinking Agent>

In order to control the molecular weight of the binder resin, a crosslinking agent may be added during the polymerization of the polymerizable monomer.

For example, the following compounds can be used as the crosslinking agent, but these examples are not limiting.

Ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol di acrylate, polyethylene glycol #200, #400, #600 diacrylate, dipropylene glycol diacrylate, polypropylene glycol diacrylate and polyester type diacrylate (MANDA, manufactured by Nippon Kayaku Co., Ltd.), and the above acrylates converted to methacrylates.

The amount of the crosslinking agent to be added is preferably from 0.001 parts by mass to 15.0 parts by mass based on 100 parts by mass of the polymerizable monomer.

<Release Agent>

The toner core particle may include a wax.

For example, the following waxes can be used, but these examples are not limiting.

Esters of monohydric alcohols and aliphatic monocarboxylic acids, or esters of monovalent carboxylic acids and aliphatic monoalcohols, such as behenyl behenate, stearyl stearate, and palmityl palmitate; esters of dihydric alcohols and aliphatic monocarboxylic acids, or esters of divalent carboxylic acids and aliphatic monoalcohols, such as dibehenyl sebacate and hexanediol dibehenate; esters of trihydric alcohols and aliphatic monocarboxylic acids, or esters of trivalent carboxylic acids and aliphatic monoalcohols, such as glycerin tribehenate; esters of tetrahydric alcohols and aliphatic monocarboxylic acids, or esters of tetravalent carboxylic acids and aliphatic monoalcohols, such as pentaerythritol tetrastearate and pentaerythritol tetrapalmitate; esters of hexahydric alcohols and aliphatic monocarboxylic acids, or esters of hexavalent carboxylic acids and aliphatic monoalcohols, such as dipentaerythritol hexastearate and dipentaerythritol hexapalmitate; esters of polyhydric alcohols and aliphatic monocarboxylic acids, or esters of polyvalent carboxylic acids and aliphatic monoalcohols, such as polyglycerin behenate; natural ester waxes such as carnauba wax and rice wax; petroleum waxes and derivatives thereof such as paraffin wax, microcrystalline wax, and petrolatum; hydrocarbon waxes and derivatives thereof obtained by the Fischer-Tropsch method; polyolefin waxes and derivatives thereof such as polyethylene wax and polypropylene wax; higher aliphatic alcohols; fatty acids such as stearic acid and palmitic acid; and acid amide waxes.

The content of the wax in the toner particle is preferably from 0.5% by mass to 20.0% by mass.

<Colorant>

The toner core particle may include a colorant. The colorant is not particularly limited, and for example, the following known colorants can be used.

Examples of yellow pigment include yellow iron oxide, and condensed azo compounds such as Navels Yellow, Naphthol Yellow S, Hanza Yellow G, Hanza Yellow 10G, Benzidine Yellow G, Benzidine Yellow GR, Quinoline Yellow Lake, Permanent Yellow NCG, and Tartrazine Lake, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, and 180.

Examples of orange pigments are presented below.

Permanent Orange GTR, Pyrazolone Orange, Vulcan Orange, Benzidine Orange G, Indanthrene Brilliant Orange RK, and Indanthrene Brilliant Orange GK.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, and perylene compounds. Specific examples are presented hereinbelow.

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, and 66.

Examples of purple pigments include Fast Violet B and Methyl Violet Lake.

Examples of green pigments include Pigment Green B, Malachite Green Lake, and Final Yellow Green G.

Examples of the white pigment include zinc white, titanium oxide, antimony white, and zinc sulfide.

Examples of black pigments include carbon black, aniline black, nonmagnetic ferrites and magnetite, and those toned to black using the abovementioned yellow colorant, red colorant and blue colorant.

These colorants may be used singly or as a mixture of a plurality thereof. These colorants can be used in the form of a solid solution.

If necessary, the colorant may be subjected to a surface treatment with a substance which does not inhibit polymerization.

The content of the colorant in the toner particle is preferably from 3.0% by mass to 15.0% by mass.

<Charge Control Agent>

The toner core particle may include a charge control agent. The charge control agent is not particularly limited, and a known charge control agent can be used. In particular, a charge control agent that has a high charging speed and can stably maintain a constant charge quantity is preferable. Further, where the toner core particles are produced by a direct polymerization method, a charge control agent having a low polymerization inhibition property and having substantially no matter soluble in an aqueous medium is particularly preferable.

Examples of charge control agents that control the toner particle to be negatively chargeable are presented hereinbelow.

Organometallic compounds and chelate compounds exemplified by monoazo metal compounds, acetylacetone metal compounds, and metal compounds based on aromatic hydroxycarboxylic acids, aromatic dicarboxylic acids, hydroxycarboxylic acids and dicarboxylic acids. Other examples include aromatic hydroxycarboxylic acids, aromatic mono- and polycarboxylic acids and metal salts, anhydrides, esters, phenol derivatives, such as bisphenol, thereof and the like. Furthermore, urea derivatives, metal-containing salicylic acid compounds, metal-containing naphthoic acid compounds, boron compounds, quaternary ammonium salts, and calixarenes can be mentioned.

Meanwhile, examples of charge control agents that control the toner particle to be positively chargeable are presented hereinbelow.

Nigrosine modified products such as nigrosine and fatty acid metal salts; guanidine compounds; imidazole compounds; quaternary ammonium salts such as tributylbenzylammonium-1-hydroxy-4-naphthosulfonate and tetrabutylammonium tetrafluoroborate, onium salts such as phosphonium salts, which are analogs thereof, and lake pigments thereof; triphenylmethane dyes and lake pigments thereof (examples of lake conversion agents include phosphorotungic acid, phosphomolybdic acid, phosphotungsten molybdic acid, tannic acids, lauric acid, gallic acid, ferricyanides, ferrocyanides, and the like); metal salts of higher fatty acids; and resin-based charge control agents.

These charge control agents can be used singly or in combination of a plurality thereof. The content of these charge control agents in the toner particle is preferably from 0.01% by mass to 10% by mass.

<External Additive>

The toner particle may be used as it is as a toner, but in order to improve flowability, charging performance, cleaning property, and the like, a fluidizing agent, a cleaning aid or the like, which is the so-called external additive, may be added to obtain the toner.

Examples of the external additive include inorganic oxide fine particles such as silica fine particles, alumina fine particles, titanium oxide fine particles, and the like; inorganic stearic acid compound fine particles such as aluminum stearate fine particles, zinc stearate fine particles and the like; inorganic titanic acid compound fine particles such as strontium titanate, zinc titanate, and the like; and the like. These can be used singly or in combination of a plurality thereof.

These inorganic fine particles are preferably subjected to a gloss treatment with a silane coupling agent, a titanium coupling agent, a higher fatty acid, a silicone oil or the like in order to improve heat-resistant storability and environmental stability. The BET specific surface area of the external additive is preferably from 10 $m^2/g$ to 450 $m^2/g$.

The BET specific surface area is determined by a low-temperature gas adsorption method based on a dynamic constant pressure method according to a BET method (preferably a BET multipoint method). For example, the BET specific surface area ($m^2/g$) is calculated by adsorbing nitrogen gas on the surface of a sample and performing measurement by the BET multipoint method by using a specific surface area measuring apparatus (trade name: GEMINI 2375 Ver. 5.0, manufactured by Shimadzu Corporation).

The total amount of these various external additives is preferably from 0.05 parts by mass to 10 parts by mass, and more preferably from 0.1 parts by mass to 5 parts by mass with respect to 100 parts by mass of the toner particles. Various external additives may be used in combination.

<Developer>

The toner can be used as a magnetic or nonmagnetic one-component developer, but it may be also mixed with a carrier and used as a two-component developer.

As the carrier, magnetic particles composed of conventionally known materials such as metals such as iron, ferrites, magnetite and alloys of these metals with metals such as aluminum, lead and the like can be used. Among them, ferrite particles are preferable. Further, a coated carrier obtained by coating the surface of magnetic particles with a coating agent such as a resin, a resin dispersion type carrier obtained by dispersing magnetic fine powder in a binder resin, or the like may be used as the carrier.

The volume average particle diameter of the carrier is preferably from 15 μm to 100 μm, and more preferably from 25 μm to 80 μm.

<Method for Producing Toner Particle>

Known methods can be used for producing the toner particle. Thus, a kneading pulverization method or a wet production method can be used. From the viewpoint of obtaining uniform particle diameter and shape controllability, the wet production method is preferable. The wet production methods can be exemplified by a suspension polymerization method, a dissolution suspension method, an emulsion polymerization aggregation method, an emulsion aggregation method, and the like.

Here, the suspension polymerization method will be described.

The suspension polymerization method may include a step of preparing a polymerizable monomer composition by uniformly dissolving or dispersing the resin A and, if necessary, other additives such as a polymerizable monomer for forming a binder resin and a colorant by using a dispersing machine such as a ball mill, an ultrasonic dispersing machine or the like (step of preparing a polymerizable monomer composition). At this time, if necessary, a polyfunctional monomer, a chain transfer agent, a wax as a release agent, a charge control agent, a plasticizer, and the like can be appropriately added.

The preferred examples of the polymerizable monomer in the suspension polymerization method include the following vinyl polymerizable monomers.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, and the like; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, 2-benzoyloxyethyl acrylate, and the like; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, dibutyl phosphate ethyl methacrylate, and the like; methylene aliphatic monocarboxylic acid esters; vinyl esters such as vinyl acetate, vinyl propionate, vinyl benzoate, vinyl butyrate, vinyl formate, and the like; vinyl ethers such as vinyl methyl ether, vinyl ethyl ether, vinyl isobutyl ether, and the like; vinyl methyl ketone, vinyl hexyl ketone, and vinyl isopropyl ketone.

The suspension polymerization method may include a step in which the polymerizable monomer composition is loaded into an aqueous medium prepared in advance, and a stirrer or a disperser having a high shear force is used to form droplets composed of the polymerizable monomer composition into toner particle of a desired size (granulation step).

The aqueous medium in the granulation step preferably includes a dispersion stabilizer in order to control the particle diameter of the toner particle, sharpen the particle size distribution, and prevent the coalescence of the toner particles in the production process. Dispersion stabilizers are generally classified into polymers that exhibit repulsion due to steric hindrance and poorly water-soluble inorganic compounds that stabilize dispersion by electrostatic repulsion. Fine particles of the poorly water-soluble inorganic compound are preferably used because they are dissolved by an acid or an alkali and, therefore, can be dissolved and easily removed by washing with an acid or an alkali after polymerization.

A dispersion stabilizer of the poorly water-soluble inorganic compound that includes any of magnesium, calcium, barium, zinc, aluminum and phosphorus can be preferably used. It is more preferable that any one of magnesium, calcium, aluminum and phosphorus be included. Specific examples are listed hereinbelow.

Sodium phosphate, magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, calcium chloride, and hydroxyapatites.

An organic compound such as polyvinyl alcohol, gelatin, methylcellulose, methylhydroxypropylcellulose, ethylcellulose, sodium salt of carboxymethylcellulose, and starch may be used in combination with the dispersion stabilizer.

These dispersion stabilizers are preferably used in an amount from 0.01 parts by mass to 2.00 parts by mass based on 100 parts by mass of the polymerizable monomer.

Furthermore, in order to make these dispersion stabilizers finer, a surfactant may be used in combination in an amount from 0.001 part by mass to 0.1 part by mass per 100 parts by mass of the polymerizable monomer. Specifically, a commercially available nonionic surfactant, a commercially available anionic surfactant, and a commercially available cationic surfactant can be used. For example, sodium dodecyl sulfate, sodium tetradecyl sulfate, sodium pentadecyl sulfate, sodium octyl sulfate, sodium oleate, sodium laurate, potassium stearate, calcium oleate and the like are preferably used.

In the suspension polymerization method, the temperature is preferably set from 50° C. to 90° C., and the polymerizable monomers contained in the polymerizable monomer composition are polymerized to obtain a toner base particle-dispersed solution (polymerization step). The polymerization step may be performed after the granulation step, or may be performed while performing the granulation step.

In the polymerization step, it is preferable to perform a stirring operation so that the temperature distribution in the container becomes uniform. The addition of a polymerization initiator can be performed at an arbitrary timing and for a required time. In addition, the temperature may be raised in the latter half of the polymerization reaction in order to obtain a desired molecular weight distribution, and further, in order to remove unreacted polymerizable monomers, by-products and the like from the system, a part of the aqueous medium may be distilled off by a distillation operation in the latter half of the reaction, or after completion of the reaction. The distillation operation can be performed under normal pressure or reduced pressure.

An oil-soluble initiator is generally used as the polymerization initiator to be used in the suspension polymerization method. Examples thereof are presented hereinbelow.

Azo compounds such as 2,2'-azobisisobutyronitrile, 2,2'-azobis-2,4-dimethylvaleronitrile, 1,1'-azobis(cyclohexane-1-carbonitrile), 2,2'-azobis-4-methoxy-2,4-dimethylvaleronitrile; and peroxide initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butylperoxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A water-soluble initiator may be used in combination, if necessary, as the polymerization initiator, and examples thereof are listed hereinbelow.

Ammonium persulfate, potassium persulfate, 2,2'-azobis (N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrile sulfonate, ferrous sulfate or hydrogen peroxide.

These polymerization initiators can be used singly or in combination of a plurality thereof. In order to control the degree of polymerization of the polymerizable monomers, a chain transfer agent, a polymerization inhibitor and the like can be further used in combination.

In the step of coating the surface of the toner core particle with the organosilicon polymer, where the toner core particle is formed in an aqueous medium, the surface layer can be formed, as described above, by adding a hydrolysate of the organosilicon compound while performing the polymerization step or the like in an aqueous medium. Further, the surface layer may be formed by using a dispersion of toner particle after polymerization as a core particle-dispersed solution and adding the hydrolysate of the organosilicon compound.

Further, in a method which does not use an aqueous medium, such as a kneading pulverization method, the surface layer can be formed by dispersing the obtained toner particle in an aqueous medium to be used as a core particle-dispersed solution, and adding the hydrolysate of the organosilicon compound as described above.

From the viewpoint of obtaining high-definition and high-resolution images, the toner particles preferably have a weight average particle diameter from 3.0 μm to 10.0 μm. The weight average particle diameter of the toner can be measured by a pore electric resistance method. For example, it can be measured using a "Coulter counter Multisizer 3" (manufactured by Beckman Coulter, Inc.). The toner particle-dispersed solution thus obtained is sent to a filtration step for solid-liquid separation of the toner particle and the aqueous medium.

Solid-liquid separation for obtaining toner particle from the obtained toner particle-dispersed solution can be performed by a general filtration method, and thereafter, washing is preferably further performed by re-slurry or washing with washing water or the like in order to remove foreign matter that could not be completely removed from the toner particle surface. After sufficient washing, solid-liquid separation is performed again to obtain a toner cake. Thereafter, the particles are dried by a known drying means, and if necessary, a particle group having a particle diameter outside a predetermined range is separated by classification to obtain toner particle. The particle group having a particle diameter outside a predetermined range that has been separated at this time may be reused in order to improve the final yield.

Methods for measuring physical property values are described below.

<Method for Preparing Tetrahydrofuran-Insoluble Matter of Toner Particle (Removal of Organosilicon Polymer)>

First, where the toner particle surface has been treated with an external additive or the like, the external additive is removed by the following method to obtain the toner particle.

A total of 160 g of sucrose (manufactured by Kishida Chemical Co., Ltd.) is added to 100 mL of ion exchanged water and dissolved using a hot water bath to prepare a condensed sucrose solution. A total of 31 g of the condensed sucrose solution and 6 mL of Contaminon N (aqueous solution including 10% by mass of a neutral cleaning agent for cleaning precision measurement devices which has pH 7 and is composed of a nonionic surfactant, an anionic surfactant and an organic builder; manufactured by Wako Pure Chemical Industries, Ltd.) are added to a centrifuge tube (capacity 50 mL) to prepare a dispersion liquid. To this dispersion liquid, 1.0 g of the toner is added, and lumps of the toner are loosened with a spatula or the like.

The centrifuge tube is reciprocally shaken for 20 min at 350 spm (strokes per min) with a shaker. The solution thus shaken is transferred to a glass tube (capacity 50 mL) for swing rotors and centrifuged under conditions of 3,500 rpm for 30 min in a centrifuge (H-9R, manufactured by Kokusan Co., Ltd.). By this operation, the detached external additive is separated from the toner particle. It is visually confirmed that the toner and the aqueous solution are sufficiently separated, and the toner separated in the uppermost layer is collected with a spatula or the like. The collected toner is filtered with a reduced pressure filter, and then dried with a dryer for 1 h or more to obtain toner particle. This operation is performed several times to ensure the required amount.

Next, the tetrahydrofuran (THF)-insoluble matter of the toner particle is prepared as follows.

A total of 10.0 g of toner particles are weighed, placed in a cylindrical filter paper (No. 84, manufactured by Toyo Filter Paper Co., Ltd.), and loaded in a Soxhlet extractor. Extraction is performed for 20 h using 200 mL of THF as a solvent. The extraction is further performed for 20 h after replacement with 200 mL of fresh THF. Finally, extraction is performed for 20 h after additional replacement with 200 mL of fresh THF (the total amount of used THF is 600 mL, and the total extraction time is 60 h).

The matter obtained by subjecting the filtrate in the cylindrical filter paper to vacuum drying at 40° C. for several hours is the tetrahydrofuran-insoluble matter. The tetrahydrofuran-insoluble matter includes the "organosilicon polymer having a structure represented by formula (A)".

Further, if necessary, a method involving the same operations as those for removing the external additive may be performed in order to remove the insoluble matter such as a pigment or the like from the tetrahydrofuran-insoluble matter and isolate the "organosilicon polymer having a structure represented by formula (A)" (the "tetrahydrofuran-insoluble matter" is used instead of the "toner". The organosilicon polymer is often isolated in a lower layer after centrifugation).

<Method for Preparing Tetrahydrofuran-Soluble Matter of Toner Particle (Removal of Resin A)>

The resin A in the toner particle is taken out by separating an extract using tetrahydrofuran (THF) by a solvent gradient elution method. The preparation method is described hereinbelow.

A total of 10.0 g of toner particles are weighed, placed in a cylindrical filter paper (No. 84, manufactured by Toyo Filter Paper Co., Ltd.), and loaded in a Soxhlet extractor. Extraction is performed for 20 h using 200 mL of THF as a solvent, and the solid matter obtained by removing the solvent from the extract is a THF-soluble matter. The resin A is contained in the THF-soluble matter. The above operations are performed a plurality of times to obtain a required amount of the THF-soluble matter.

Gradient preparative HPLC (LC-20AP high-pressure gradient preparative system manufactured by Shimadzu Corporation, SunFire preparative column 50 mmφ 250 mm manufactured by Waters Co., Ltd.) is used for the solvent gradient elution method. The column temperature is 30° C., the flow rate is 50 mL/min, acetonitrile is used as a poor solvent for the mobile phase, and THF is used as a good solvent. A solution obtained by dissolving 0.02 g of the THF-soluble matter obtained by the extraction in 1.5 mL of THF is used as a sample for separation. The mobile phase starts with a composition of 100% acetonitrile, and after 5 min from the sample injection, the ratio of THF is increased by 4% every minute, and the composition of the mobile phase is made 100% THF over 25 min. The components can be separated by drying the obtained fraction. As a result, the resin A can be obtained. Which fraction component is the resin A can be determined by measurement of the content of silicon atoms and $^{13}$C-NMR measurement described hereinbelow.

<Method for Measuring Content of Silicon Atoms in Resin a or Organosilicon Polymer>

The measurement of the content of silicon in the resin A or the organosilicon polymer is performed by using a wavelength-dispersive X-ray fluorescence spectrometer "Axios" (manufactured by PANalytical) and dedicated software "SuperQ ver. 4.0F" (manufactured by PANalytical) for setting measurement conditions and analyzing measurement data. Rh is used as the anode of the X-ray tube, the measurement atmosphere is vacuum, the measurement diameter (collimator mask diameter) is 27 mm, and the measurement time is 10 sec. When a light element is measured, a proportional counter (PC) is used for detection, and when a heavy element is measured, a scintillation counter (SC) is used for detection.

A pellet obtained by placing 4 g of the resin A, or 4 g of the tetrahydrofuran-soluble matter obtained by the aforementioned preparation method, or 4 g of the organosilicon polymer, or 4 g of the tetrahydrofuran-insoluble matter in a dedicated aluminum ring for pressing, flattening, pressurizing at 20 MPa for 60 seconds using a tablet molding compressor "BRE-32" (manufactured by Maekawa Testing Machine Co., Ltd.), and molding to a thickness of 2 mm and a diameter of 39 mm is used as a measurement sample.

Further, $SiO_2$ particles (hydrophobic fumed silica) [trade name: AEROSIL NAX50, specific surface area: 40±10 $m^2/g$, carbon content: from 0.45% to 0.85%; manufactured by Nippon Aerosil Co., Ltd.) were added to constitute 0.5 parts by mass with respect to 100 parts by mass binder particles [trade name: Spectro Blend, components: C 81.0% by mass, O 2.9% by mass, H 13.5% by mass, N 2.6% by mass, chemical formula: $C_{19}H_{38}ON$, shape: powder (44 μm); manufactured by Rigaku Corp.], followed by sufficient mixing using a coffee mill. Similarly, the $SiO_2$ particles are mixed with the binder particles so as to constitute 5.0 parts by mass and 10.0 parts by mass, respectively, and these are used as samples for a calibration curve.

For each sample, a pellet for a calibration curve sample is prepared as described above using the tablet molding compressor, and the count rate (unit: cps) of the Si-Kα rays observed at the diffraction angle (2θ)=109.08° when PET is used for a spectral crystal is measured. At this time, the acceleration voltage and the current value of the X-ray generator are set to 24 kV and 100 mA, respectively. A calibration curve of a linear function is obtained in which the obtained X-ray count rate is plotted on the ordinate and the addition amount of $SiO_2$ particles in each calibration curve sample is plotted on the horizontal axis.

Next, the resin A, or the tetrahydrofuran-soluble matter obtained by the aforementioned preparation method, or the organosilicon polymer, or the tetrahydrofuran-insoluble matter, which is the analysis object, is formed into pellets by using the abovementioned tablet molding compressor, and the count rate of the Si-Kα ray thereof is measured. Then, the content of silicon atoms in the resin A, or the tetrahydrofuran-soluble matter, or the organic silicon polymer or the tetrahydrofuran-insoluble matter is determined from the abovementioned calibration curve.

<Method for Confirming Structure Represented by Formula (A)>

The structure represented by the formula (A) in the organosilicon polymer contained in the toner particle is confirmed by the following method.

The alkyl group represented by $R^4$ in the formula (A) is confirmed by $^{13}$C-NMR.

(Measurement conditions of $^{13}$C-NMR (solid fraction))
Device: JNM-ECX500II manufactured by JEOL RESONANCE Co., Ltd.
Sample tube: 3.2 mmφ
Sample: tetrahydrofuran insoluble matter obtained by the abovementioned preparation method, 150 mg
Measurement temperature: room temperature
Pulse mode: CP/MAS
Measurement nucleus frequency: 123.25 MHz ($^{13}$C)
Reference substance: adamantane (external reference: 29.5 ppm)
Sample rotation speed: 20 kHz
Contact time: 2 ms
Delay time: 2 s
Accumulated number: 2,000 to 8,000 times According to the method, the alkyl group represented by $R^4$ in the formula (A) is confirmed by the presence or absence of a signal originated from a methyl group (Si—$CH_3$), an ethyl group (Si—$C_2H_5$), a propyl group (Si—$C_3H_7$), a butyl group (Si—$C_4H_9$), a pentyl group (Si—$O_5H_{11}$), a hexyl group (Si—$C_6H_{13}$) or a phenyl group (Si—$C_6H_5$) bonded to a silicon atom.

<Method for Calculating Proportion of Peak Area Taken by Partial Structure Represented by Formula (A) to Total Peak Area of Organosilicon Polymer>

$^{29}$Si-NMR (solid) measurement of the tetrahydrofuran insoluble matter of the toner particle is performed under the following measurement conditions.

(Measurement Conditions of $^{29}$Si-NMR (Solid))
Device: JNM-ECX500II manufactured by JEOL RESONANCE Co., Ltd.
Sample tube: 3.2 mmφ
Sample: tetrahydrofuran-insoluble matter of toner particle for NMR measurement, 150 mg
Measurement temperature: room temperature
Pulse mode: CP/MAS
Measurement nucleus frequency: 97.38 MHz ($^{29}$Si)
Reference substance: DSS (external reference: 1.534 ppm)
Sample rotation speed: 10 kHz
Contact time: 10 ms
Delay time: 2 s
Accumulated number: 2,000 to 8,000 times After the above measurement, a plurality of silane components having different substituents and bonding groups in the THF-insoluble matter of the toner particle are peak-separated into X1 structure, X2 structure, X3 structure, and X4 structure in the following FIGURE by curve fitting, and each peak area is calculated.

X1 structure: $(R_i)(R_j)(R_k)SiO_{1/2}$
X2 structure: $(R_g)(R_h)Si(O_{1/2})_2$
X3 structure: $R_mSi(O_{1/2})_3$
X4 structure: $Si(O_{1/2})_4$ X1 structure

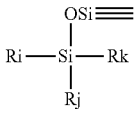

X2 structure

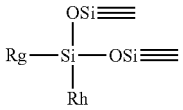

X3 structure

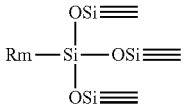

X4 structure

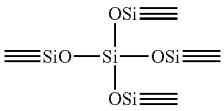

In the FIGURE hereinabove, $R_i$, $R_j$, $R_k$, $R_g$, $R_h$, and $R_m$ in the structures X1 to X3 each independently represent an organic group such as an alkyl group having from 1 to 6 carbon atoms, a halogen atom, a hydroxy group, an acetoxy group or an alkoxy group bonded to silicon.

Then, the proportion of the X3 structure is calculated, and the proportion of peak area of the structure represented by the formula (A) to the total peak area of the organosilicon polymer is calculated.

When it is necessary to confirm the structure represented by the formula (A) in more detail, the structure may be identified by $^{1}$H-NMR measurement results together with the $^{13}$C-NMR and $^{29}$Si-NMR measurement results.

<Identification of Structure Represented by Formula (1)>

The polymer segment $P^1$, segment $L^1$ and segments $R^1$ to $R^3$ in the structure represented by the formula (1) are analyzed by $^{1}$H-NMR analysis, $^{13}$C-NMR analysis, $^{29}$Si-NMR analysis and FT-IR analysis. As an analysis sample, a tetrahydrofuran-soluble matter obtained by the abovementioned preparation method or a resin A synthesized separately is used.

Where $L^1$ includes an amide bond represented by the formula (2), the identification can be performed by $^{1}$H-NMR analysis. Specifically, identification is possible by the chemical shift value of the proton at the NH site of the amide group, and quantification of the amide group is possible by calculating the integral value.

Where $R^1$ to $R^3$ in the structure represented by the formula (1) include an alkoxy group or a hydroxy group, the valence of the alkoxy group or the hydroxy group relative to the silicon atom can be determined by the same method as in (Measurement conditions of $^{29}$Si-NMR (solid)) hereinabove. As an analysis sample, a tetrahydrofuran-soluble matter obtained by the abovementioned preparation method or a resin A synthesized separately is used.

Specifically, the valence can be calculated by calculating the ratio of the X1 to X4 structures in the measurement data and calculating the ratio of the peak area derived from the alkoxy group or the hydroxy group.

<Method for Measuring Weight Average Molecular Weight (Mw)>

The weight average molecular weight (Mw) of the resin is measured by gel permeation chromatography (GPC) in the following manner.

First, the sample is dissolved in tetrahydrofuran (THF) at room temperature for 24 h. Then, the obtained solution is filtered through a solvent-resistant membrane filter "Mysyori Disc" (manufactured by Tosoh Corporation) having a pore diameter of 0.2 μm to obtain a sample solution. The sample solution is prepared so that the concentration of the components soluble in THF is about 0.8% by mass. Using this sample solution, measurement is performed under the following conditions.

Device: HLC8120 GPC (detector: RI) (manufactured by Tosoh Corporation)

Column: seven columns of Shodex KF-801, 802, 803, 804, 805, 806, and 807 (manufactured by Showa Denko KK)

Eluent: tetrahydrofuran (THF)

Flow rate: 1.0 mL/min

Oven temperature: 40.0° C.

Sample injection volume: 0.10 mL

In calculating the molecular weight of the sample, a molecular weight calibration curve created using a standard polystyrene resin (trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corporation) is used.

<Method for Measuring Resin Acid Value Av>

The acid value is the number of milligrams of potassium hydroxide required to neutralize the acid contained in 1 g of the sample. The acid value of the resin is measured according to JIS K 0070-1992. Specifically, the acid value is measured according to the following procedure.

(1) Preparation of Reagent

A total of 1.0 g of phenolphthalein is dissolved in 90 mL of ethyl alcohol (95% by volume), and ion exchanged water is added to make 100 mL and obtain a phenolphthalein solution.

A total of 7 g of special grade potassium hydroxide is dissolved in 5 mL of water and ethyl alcohol (95% by volume) is added to make 1 L. The solution is placed in an alkali-resistant container and allowed to stand for 3 days so as not to be exposed to carbon dioxide gas and the like, and then filtered to obtain a potassium hydroxide solution. The obtained potassium hydroxide solution is stored in an alkali-resistant container.

A total of 25 mL of 0.1 mol/L hydrochloric acid is placed in an Erlenmeyer flask, several drops of the phenolphthalein solution are added, titration is performed with the potassium hydroxide solution, and the factor of the potassium hydroxide solution is determined from the amount of the potassium hydroxide solution required for neutralization. The 0.1 mol/L hydrochloric acid prepared according to JIS K 8001-1998 is used.

(2) Operation (A) Main Test

A total of 2.0 g of pulverized sample is precisely weighed in a 200 ml Erlenmeyer flask, 100 ml of a mixed solution of toluene/ethanol (2:1) is added, and dissolution is performed for 5 h. Next, several drops of the phenolphthalein solution are added as an indicator, and titration is performed using the potassium hydroxide solution. The end point of the titration is when the light red color of the indicator continues for about 30 sec.

(B) Blank Test

The same titration as in the above procedure is performed except that no sample is used (that is, only a mixed solution of toluene/ethanol (2:1) is used).

(3) The Obtained Result is Substituted into the Following Equation to Calculate the Acid Value.

$$A=[(C-B)\times f\times 5.61]/S$$

Here, A: acid value (mg KOH/g), B: addition amount (ml) of the potassium hydroxide solution in the blank test, C: addition amount (ml) of the potassium hydroxide solution in the main test, f: potassium hydroxide solution factor, and S: mass (g) of the sample.

<Method for Measuring Hydroxyl Value OHv of Resin>

The hydroxyl value is the number of milligrams of potassium hydroxide required to neutralize acetic acid bonded to a hydroxy group when acetylating 1 g of a sample. The hydroxyl value of the resin is measured according to JIS K 0070-1992. Specifically, the hydroxyl value is measured according to the following procedure.

(1) Preparation of Reagent

A total of 25 g of special grade acetic anhydride is put into a 100 mL volumetric flask, pyridine is added to make the total volume 100 mL, and thorough shaking is performed to obtain an acetylating reagent. The obtained acetylating reagent is stored in a brown bottle to prevent exposure to moisture, carbon dioxide gas and the like.

A total of 1.0 g of phenolphthalein is dissolved in 90 mL of ethyl alcohol (95% by volume), and ion exchanged water is added to make 100 mL to obtain a phenolphthalein solution.

A total of 35 g of special grade potassium hydroxide is dissolved in 20 mL of water, and ethyl alcohol (95% by volume) is added to make 1 L. The solution is placed in an alkali-resistant container and allowed to stand for 3 days so as not to be exposed to carbon dioxide gas and the like, and then filtered to obtain a potassium hydroxide solution. The obtained potassium hydroxide solution is stored in an alkali-resistant container.

A total of 25 mL of 0.5 mol/L hydrochloric acid is placed in an Erlenmeyer flask, several drops of the phenolphthalein solution are added, titration is performed with the potassium hydroxide solution, and the factor of the potassium hydroxide solution is determined from the amount of the potassium hydroxide solution required for neutralization. The 0.5 mol/L hydrochloric acid prepared according to JIS K 8001-1998 is used.

(2) Operation (A) Main Test

A total of 1.0 g of pulverized sample is precisely weighed in a 200 ml round bottom flask, and 5.0 mL of the acetylating reagent is accurately added thereto using a whole pipette. At this time, when the sample is difficult to dissolve in the acetylation reagent, a small amount of special grade toluene is added and dissolved.

A small funnel is placed on the mouth of the flask, the flask is immersed to about 1 cm from the bottom in a glycerin bath at about 97° C. and heated. At this time, in order to prevent the temperature of the neck of the flask from rising due to the heat of the bath, it is preferable to cover the base of the neck of the flask with cardboard having a round hole.

After 1 h, the flask is removed from the glycerin bath and allowed to cool. After cooling, 1 mL of water is added from the funnel and the flask is shaken to hydrolyze acetic anhydride. The flask is again heated in the glycerin bath for 10 min for more complete hydrolysis. After allowing to cool, the funnel and flask walls are washed with 5 mL of ethyl alcohol.

Several drops of the phenolphthalein solution as an indicator are added and titration is performed with the potassium hydroxide solution. The end point of the titration is when the light red color of the indicator continues for about 30 sec.

(B) Blank Test

The same titration as in the above procedure is performed except that no sample is used.

(3) The Obtained Result is Substituted into the Following Equation to Calculate the Hydroxyl Value.

$$A=[\{(B-C)\times 28.05\times f\}/S]+D$$

Here, A: hydroxyl value (mg KOH/g), B: addition amount (mL) of the potassium hydroxide solution in the blank test, C: addition amount (mL) of the potassium hydroxide solution in the main test, f: potassium hydroxide solution factor, S: mass (g) of the sample, and D: acid value of the sample (mg KOH/g).

EXAMPLES

Hereinafter, the present disclosure will be specifically described with reference to Examples, but the present disclosure is not limited to these Examples. All parts in Examples and Comparative Examples are based on mass unless otherwise specified.

<Synthesis of Polyester (A-1)>

Polyester (A-1) was synthesized by the following procedure.

The following materials were loaded into an autoclave equipped with a decompression device, a water separation device, a nitrogen gas introduction device, a temperature measurement device, and a stirring device, and the reaction was conducted at 200° C. for 5 h under a nitrogen atmosphere at normal pressure.

Bisphenol A—propylene oxide 2.1 mol adduct: 39.6 parts
Terephthalic acid: 8.0 parts
Isophthalic acid: 7.6 parts
Tetrabutoxytitanium: 0.1 part Thereafter, 0.01 parts of trimellitic acid and 0.12 parts of tetrabutoxytitanium were added, reacted at 220° C. for 3 h, and further reacted under reduced pressure of 10 mmHg to 20 mmHg for 2 h to obtain a polyester (A-1).

The obtained polyester (A-1) had an acid value of 6.1 mg KOH/g, a hydroxyl value of 33.6 mg KOH/g, and Mw=10200.

<Synthesis of Polyester (A-2)>

A polyester (A-2) was obtained in the same manner as in the synthesis of the polyester (A-1), except that 39.6 parts of a bisphenol A—propylene oxide 2.1 mol adduct was replaced with 33.2 parts of a bisphenol A—ethylene oxide 2 mol adduct.

The obtained polyester (A-2) had an acid value of 5.8 mg KOH/g, a hydroxyl value of 34.3 mg KOH/g, and Mw=10,800.

<Synthesis of Polyester (A-3)>

A polyester (A-3) was synthesized by the following procedure.

The following materials were loaded into an autoclave equipped with a decompression device, a water separation device, a nitrogen gas introduction device, a temperature measurement device, and a stirring device, and the reaction was conducted at 200° C. for 5 h under a nitrogen atmosphere at normal pressure.

Bisphenol A—propylene oxide 2 mol adduct: 21.0 parts
Ethylene glycol: 2.1 parts
Isosorbide: 0.6 parts
Terephthalic acid: 14.8 parts
Tetrabutoxytitanium: 0.1 part Thereafter, 1.1 parts of trimellitic acid and 0.1 part of tetrabutoxytitanium were added, reacted at 220° C. for 3 h, and further reacted under reduced pressure of 10 mmHg to 20 mmHg for 2 h to obtain a polyester (A-3).

The obtained polyester (A-3) had an acid value of 6.0 mg KOH/g, a hydroxyl value of 32.4 mg KOH/g, and Mw of 10,400.

<Synthesis of Polyester (A-4)>

Poly ε-caprolactone [polyester (A-4)] in which a carboxylic acid terminal is a stearyl ester was synthesized by the following procedure.

The following materials were charged into a reaction container equipped with a nitrogen gas introduction device, a temperature measuring device, and a stirring device, and the reaction was conducted for 100° C. for 5 h in a nitrogen atmosphere.

Stearyl alcohol: 3.0 parts

ε-Caprolactone: 38.2 parts

Titanium (IV) tetraisopropoxide: 0.5 part

The obtained resin was dissolved in chloroform, the solution was dropped into methanol, reprecipitated, and filtered to obtain a polyester (A-4).

The obtained polyester (A-4) had an acid value of 0.0 mg KOH/g, a hydroxyl value of 30.3 mg KOH/g, and Mw=8,300.

<Synthesis of Polyester (A-5)>

Polylactic acid [polyester (A-5)] was synthesized by the following procedure.

The following materials were loaded into an autoclave equipped with a decompression device, a water separation device, a nitrogen gas introduction device, a temperature measurement device, and a stirring device, and the reaction was conducted at 200° C. for 5 h under a nitrogen atmosphere at normal pressure.

Lactic acid: 100.0 parts

Tetrabutoxytitanium: 0.1 part

Thereafter, 0.1 part of tetrabutoxytitanium was added and reacted at 220° C. for 3 h, and the reaction was further conducted under reduced pressure of 10 mmHg to 20 mmHg for 2 h. The obtained resin was dissolved in chloroform, and the solution was dropped into ethanol, reprecipitated, and filtered to obtain a polyester (A-5).

The acid value of the obtained polyester (A-5) was 3.5 mg KOH/g and Mw=30,000.

<Synthesis of Polyesters (A-6) and (A-7)>

The polyesters (A-6) and (A-7) were synthesized in the same manner as in the synthesis of the polyester (A-1), except that the reaction pressure, reaction temperature and reaction time were adjusted to obtain the desired molecular weight.

Table 1 shows the physical properties of the obtained polyesters (A-6) and (A-7).

<Synthesis of Styrene Acrylic Resin (A-8)>

A styrene acrylic resin (A-8) was synthesized in the following manner. A total of 100.0 parts of propylene glycol monomethyl ether was heated while replacing with nitrogen, and refluxed at a liquid temperature of 120° C. or higher. Thereto, 80.2 parts of styrene, 20.1 parts of butyl acrylate, 5.0 parts of acrylic acid, and 1.0 part of tert-butyl peroxybenzoate [organic peroxide-based polymerization initiator, manufactured by NOF Corporation, trade name: PERBUTYL Z] were added dropwise over 3 h.

After completion of the dropwise addition, the solution was stirred for 3 h, and then distilled under normal pressure while increasing the temperature of the solution to 170° C. After the liquid temperature reached 170° C., the pressure was reduced to 1 hPa, and the solvent was removed by distillation over 1 h to obtain a resin solid matter. The resin solid matter was dissolved in tetrahydrofuran and reprecipitated with n-hexane, and the precipitated solid matter was separated by filtration to obtain a styrene acrylic resin (A-8).

The acid value of the obtained styrene acrylic resin (A-8) was 36.6 mg KOH/g and Mw=22,000.

<Synthesis of Styrene Acrylic Resin (A-9)>

Styrene acrylic resin (A-9) was synthesized in the following manner.

A total of 100.0 parts of propylene glycol monomethyl ether was heated while replacing with nitrogen, and refluxed at a liquid temperature of 120° C. or higher. Thereto, 72.9 parts of styrene, 21.6 parts of acrylic acid, and 1.0 part of tert-butyl peroxybenzoate [organic peroxide-based polymerization initiator, manufactured by NOF Corporation, trade name: PERBUTYL Z] were added dropwise over 3 h.

After completion of the dropwise addition, the solution was stirred for 3 h, and then distilled under normal pressure while increasing the temperature of the solution to 170° C. After the liquid temperature reached 170° C., the pressure was reduced to 1 hPa, and the solvent was removed by distillation over 1 h to obtain a resin solid matter. The resin solid matter was dissolved in tetrahydrofuran and reprecipitated with n-hexane, and the precipitated solid matter was separated by filtration to obtain a styrene acrylic resin (A-9).

The acid value of the obtained styrene acrylic resin (A-9) was 154.6 mg KOH/g and Mw=22,000.

<Synthesis of Acrylic Resin (A-10)>

Acrylic resin (A-10) was synthesized in the following manner.

A total of 100.0 parts of propylene glycol monomethyl ether was heated while replacing with nitrogen, and refluxed at a liquid temperature of 120° C. or higher. Thereto, 30.0 parts of methyl methacrylate, 50.4 parts of acrylic acid, and 1.0 part of tert-butyl peroxybenzoate [organic peroxide-based polymerization initiator, manufactured by NOF Corporation, trade name: PERBUTYL Z] were added dropwise over 3 h.

After completion of the dropwise addition, the solution was stirred for 3 h, and then distilled under normal pressure while increasing the temperature of the solution to 170° C. After the liquid temperature reached 170° C., the pressure was reduced to 1 hPa, and the solvent was removed by distillation over 1 h to obtain a resin solid matter. The resin solid matter was dissolved in tetrahydrofuran and reprecipitated with n-hexane, and the precipitated solid matter was separated by filtration to obtain a styrene acrylic resin (A-10).

The acid value of the obtained styrene acrylic resin (A-10) was 351.8 mg KOH/g and Mw=8,700.

<Synthesis of Resin A (R-1)>

The carboxy group in the polyester (A-1) and the amino group in the aminosilane were amidated to synthesize a resin A (R-1) in the following manner.

A total of 50.0 parts of polyester (A-1) was dissolved in 200.0 parts of N,N-dimethylacetamide, 1.2 parts of 3-aminopropyltriethoxysilane and 1.7 parts of DMT-MM (4-(4,6-dimethoxy-1,3,5-triazin-2-yl)-4-methylmorpholinium chloride) as a condensation agent were added, and stirring was performed at room temperature for 5 h. After completion of the reaction, the solution was dropped into methanol, reprecipitated, and filtered to obtain a resin A (R-1).

Table 2 shows the physical properties of the obtained resin A (R-1).

<Synthesis of Resins A (R-2), (R-3), and (R-13) to (R-16)>

Each of resins A (R-2), (R-3) and (R-13) to (R-16) was synthesized in the same manner as in the synthesis of the resin A (R-1), except that 1.2 parts of 3-aminopropyltriethoxysilane was changed to respective "Type and amount of modified silicon compound added" shown in Table 1.

Table 2 shows the physical properties of the obtained resins A.

<Synthesis of Resins A (R-7), (R-9), (R-17) to (R-21), (R-23), and (R-24)>

Each of resins A (R-7), (R-9), (R-17) to (R-21), (R-23), and (R-24) was synthesized in the same manner as in the synthesis of the resin A (R-1), except that the polyester (A-1) was replaced with the respective "Type of starting material resin serving as base" shown in Table 1, the amount of 3-aminopropyltriethoxysilane was changed from 1.2 part to the respective "Amount of modified silicon compound added", and the amount of DMT-MM was changed from 1.7 parts to the respective "Amount of condensation agent (DMT-MM)".

Table 2 shows the physical properties of the obtained resin A.

<Synthesis of Resin A (R-4)>

Resin A (R-4) having a urethane bond formed by reacting a hydroxy group in the polyester (A-1) with an isocyanate group in isocyanate silane was synthesized in the following manner.

A total of 50.0 parts of polyester (A-1) was dissolved in 500.0 parts of chloroform, 1.3 parts of 3-isocyanatopropyltriethoxysilane and 0.5 part of titanium (IV) tetraisopropoxide were added under a nitrogen atmosphere and stirring was performed at room temperature for 5 h. After completion of the reaction, the solution was dropped into methanol, reprecipitated, and filtered to obtain a resin A (R-4).

Table 2 shows the physical properties of the obtained resin A (R-4).

<Synthesis of Resin A (R-8)>

A resin A (R-8) was synthesized in the same manner as in the synthesis of the resin A (R-4), except than the polyester (A-1) was replaced with the polyester (A-4), and the amount of 3-isocyanatopropyltriethoxysilane was changed from 1.3 parts to 6.6 parts.

Table 2 shows the physical properties of the obtained resin A (R-8).

<Synthesis of Resin A (R-5)>

Resin A (R-5) having a linking group represented by formula (4) or (5) that was formed by an insertion reaction of an epoxy group in epoxy silane into an ester bond in the polyester (A-1) was synthesized.

A total of 50.0 parts of polyester (A-1) was dissolved in 100.0 parts of anisole, 2.9 parts of 5,6-epoxyhexyltriethoxysilane and 10.0 parts of tetrabutylphosphonium bromide were added, and heating and stirring were performed at about 140° C. for 5 h. After cooling, the reaction mixture was dissolved in 200 ml of chloroform, dropped into methanol, reprecipitated, and filtered to obtain a resin A (R-5).

Table 2 shows the physical properties of the obtained resin A (R-5).

<Synthesis of Resin A (R-6)>

A resin A (R-6) was synthesized in the same manner as in the synthesis of the resin A (R-5), except that the polyester (A-1) was replaced with the polyester (A-2), and 2.9 parts of 5,6-epoxyhexyltriethoxysilane was replaced with 12.2 parts of (3-glycidoxypropyl)trimethoxysilane.

Table 2 shows the physical properties of the obtained resin A (R-6).

<Synthesis of Resin A (R-10)>

A total of 400.0 parts of pure water was mixed and stirred with a solution of 10.0 parts of the resin A (R-1) in 90.0 parts of toluene. After the stirring, the pH was adjusted to 5.0 using dilute hydrochloric acid, stirring was performed at room temperature for 2.4 h, and then the stirring was stopped and the mixture was transferred to a separating funnel to extract an oil phase. The oil phase was concentrated and reprecipitated with methanol to obtain a resin A (R-10) in which one alkoxy group was hydrolyzed.

Table 2 shows the physical properties of the obtained resin A (R-10).

<Synthesis of Resin A (R-11)>

A resin A (R-11) in which two alkoxy groups were hydrolyzed was obtained in the same manner as in the synthesis of the resin A (R-10), except that the pH was changed from 5.0 to 4.0, and the stirring time was changed from 2.4 h to 3.8 h.

Table 2 shows the physical properties of the obtained resin A (R-11).

<Synthesis of Resin A (R-12)>

A resin A (R-12) in which three alkoxy groups were hydrolyzed was obtained in the same manner as in the synthesis of the resin A (R-11), except that the stirring time was changed from 3.8 h to 10.8 h.

Table 2 shows the physical properties of the obtained resin A (R-12).

TABLE 1

| | Starting material resin serving as a base | | | | Modified silicon compound added | | Condensation agent |
|---|---|---|---|---|---|---|---|
| Resin A Type | Type | Mw | Acid value (mgKOH/g) | Hydroxyl value (mgKOH/g) | Type | Amount (parts) | (DMT-MM) Amount (parts) |
| R-1 | A-1 | 10200 | 6.1 | 33.6 | 3-Aminopropyltriethoxysilane | 1.2 | 1.7 |
| R-2 | | | | | 11-Aminoundecyltriethoxysilane | 1.8 | |
| R-3 | | | | | Aminophenyltrimethoxysilane | 1.2 | |
| R-4 | | | | | 3-Isocyanatopropyltriethoxysilane | 1.3 | — |
| R-5 | | | | | 5,6-Epoxyhexyltriethoxysilane | 2.9 | — |
| R-6 | A-2 | 10800 | 5.8 | 34.3 | (3-Glycidoxypropyl)trimethoxysilane | 12.2 | — |
| R-7 | A-3 | 10400 | 6.0 | 32.4 | 3-Aminopropyltriethoxysilane | 1.1 | 1.6 |
| R-8 | A-4 | 8300 | 0.0 | 30.3 | 3-Isocyanatopropyltriethoxysilane | 6.6 | — |
| R-9 | A-5 | 30000 | 3.5 | — | 3-Aminopropyltriethoxysilane | 0.7 | 0.9 |
| R-10 | A-1 | 10200 | 6.1 | 33.6 | 3-Aminopropyltriethoxysilane | 1.2 | 1.7 |
| R-11 | | | | | | | |
| R-12 | | | | | | | |

TABLE 1-continued

| Resin A Type | Starting material resin serving as a base Type | Mw | Acid value (mgKOH/g) | Hydroxyl value (mgKOH/g) | Modified silicon compound added Type | Amount (parts) | Condensation agent (DMT-MM) Amount (parts) |
|---|---|---|---|---|---|---|---|
| R-13 | | | | | 3-Aminopropylmethyldiethoxysilane | 1.0 | |
| R-14 | | | | | 3-Aminopropyldimethylethoxysilane | 0.9 | |
| R-15 | | | | | 3-Aminopropyltrimethylsilane | 0.7 | |
| R-16 | | | | | 3-Aminopropylsilicon | 0.5 | |
| R-17 | A-6 | 99600 | 0.2 | 30.4 | 3-Aminopropyltriethoxysilane | 0.03 | 0.04 |
| R-18 | A-7 | 1800 | 30.9 | 14.2 | | 6.1 | 8.4 |
| R-19 | A-8 | 22000 | 36.6 | — | | 7.1 | 9.8 |
| R-20 | A-9 | 22000 | 154.6 | — | | 30.4 | 41.8 |
| R-21 | A-10 | 8700 | 351.8 | — | | 60.9 | 83.8 |
| R-23 | A-6 | 99600 | 0.2 | 30.4 | | 0.015 | 0.02 |
| R-24 | A-10 | 8700 | 351.8 | — | | 69.2 | 95.2 |

TABLE 2

| Type | $P^1$ | $R^1$ | $R^2$ | $R^3$ | $L^1$ | $R^5$ | $R^6$ | $R^7$ or $R^8$ | Mw | *1 |
|---|---|---|---|---|---|---|---|---|---|---|
| R-1 | A-1 | OEt | OEt | OEt | Formula (2) | $—C_3H_6—$ | | | 11300 | 0.22 |
| R-2 | A-1 | OEt | OEt | OEt | Formula (2) | $—C_{11}H_{22}$ | | | 12000 | 0.15 |
| R-3 | A-1 | OMe | OMe | OMe | Formula (2) | $—C_6H_4—$ | | | 11800 | 0.22 |
| R-4 | A-1 | OEt | OEt | OEt | Formula (3) | | $—C_3H_6—$ | | 13100 | 0.21 |
| R-5 | A-1 | OEt | OEt | OEt | Formula (4) or (5) | | | $—C_4H_8—$ | 15300 | 0.62 |
| R-6 | A-2 | OMe | OMe | OMe | Formula (4) or (5) | | | $—CH_2—O—C_3H_6—$ | 16100 | 1.91 |
| R-7 | A-3 | OEt | OEt | OEt | Formula (2) | $—C_3H_6—$ | | | 10500 | 0.22 |
| R-8 | A-4 | OEt | OEt | OEt | Formula (3) | | $—C_3H_6—$ | | 8400 | 0.97 |
| R-9 | A-5 | OEt | OEt | OEt | Formula (2) | $—C_3H_6—$ | | | 30500 | 0.20 |
| R-10 | A-1 | OEt | OEt | OH | Formula (2) | $—C_3H_6—$ | | | 11000 | 0.25 |
| R-11 | A-1 | OEt | OH | OH | Formula (2) | $—C_3H_6—$ | | | 10800 | 0.21 |
| R-12 | A-1 | OH | OH | OH | Formula (2) | $—C_3H_6—$ | | | 13000 | 0.20 |
| R-13 | A-1 | OEt | OEt | Me | Formula (2) | $—C_3H_6—$ | | | 13400 | 0.19 |
| R-14 | A-1 | OEt | Me | Me | Formula (2) | $—C_3H_6—$ | | | 12800 | 0.23 |
| R-15 | A-1 | Me | Me | Me | Formula (2) | $—C_3H_6—$ | | | 12500 | 0.24 |
| R-16 | A-1 | H | H | H | Formula (2) | $—C_3H_6—$ | | | 11400 | 0.28 |
| R-17 | A-6 | OEt | OEt | OEt | Formula (2) | $—C_3H_6—$ | | | 99700 | 0.02 |
| R-18 | A-7 | OEt | OEt | OEt | Formula (2) | $—C_3H_6—$ | | | 2100 | 0.95 |
| R-19 | A-8 | OEt | OEt | OEt | Formula (2) | $—C_3H_6—$ | | | 25800 | 1.14 |
| R-20 | A-9 | OEt | OEt | OEt | Formula (2) | $—C_3H_6—$ | | | 34700 | 4.78 |
| R-21 | A-10 | OEt | OEt | OEt | Formula (2) | $—C_3H_6—$ | | | 21000 | 9.80 |
| R-23 | A-6 | OEt | OEt | OEt | Formula (2) | $—C_3H_6—$ | | | 99650 | 0.01 |
| R-24 | A-10 | OEt | OEt | OEt | Formula (2) | $—C_3H_6—$ | | | 21900 | 10.80 |

*1: Silicon atom content in resin A (% by mass)

<Production Example of Toner Base Particle-Dispersed Solution 1>

(Production Example of Aqueous Medium 1)

A total of 390.0 parts of ion exchanged water and 14.0 parts of sodium phosphate (dodecahydrate) (manufactured by Rasa Industries, Ltd.) were loaded into a reaction container, and the temperature was maintained at 65° C. for 1.0 h while purging with nitrogen.

An aqueous solution of calcium chloride obtained by dissolving 9.2 parts of calcium chloride (dihydrate) in 10.0 parts of ion exchanged water was added all at once, while stirring at 12,000 rpm by using T. K. HOMOMIXER (manufactured by Tokushu Kika Kogyo Co., Ltd.), to prepare an aqueous medium including a dispersion stabilizer.

Further, 10% hydrochloric acid was added to the aqueous medium to adjust the pH to 6.0, whereby an aqueous medium 1 was obtained.

(Production Example of Polymerizable Monomer Composition 1)

| | |
|---|---|
| Styrene | 60.0 parts |
| Colorant (C. I. Pigment Blue 15:3) | 6.5 parts |

The above-mentioned materials were put into an attritor (manufactured by Nippon Coke Industry Co., Ltd.), and further dispersed using zirconia particles having a diameter of 1.7 mm at 220 rpm for 5.0 h to prepare a dispersion liquid 1 in which the colorant was dispersed.

The following materials were added to the dispersion liquid 1.

| | |
|---|---|
| Styrene | 20.0 parts |
| n-Butyl acrylate | 20.0 parts |
| Resin A (R-1) | 3.0 parts |
| Polyester (A-1) | 5.0 parts |
| Fisher-Tropsch wax (melting point: 78° C.) | 7.0 parts |

The components were uniformly dissolved and dispersed at 500 rpm by using T. K. HOMOMIXER, while maintaining the temperature at 65° C., to prepare a polymerizable monomer composition 1.

(Granulation Step)

The polymerizable monomer composition 1 was loaded into the aqueous medium 1 while maintaining the temperature of the aqueous medium 1 at 70° C. and the rotation speed of the stirrer at 12,000 rpm, and 9.0 parts of t-butyl peroxypivalate, which is a polymerization initiator, was added. Granulation was carried out for 10 min while maintaining 12,000 rpm with the stirring device.

(Polymerization Step)

A high-speed stirrer was changed to a stirrer equipped with a propeller stirring blade, polymerization was performed for 5.0 h while stirring at 150 rpm and maintaining 70° C., and the temperature was further raised to 85° C. and heating was performed for 2.0 h to carry out a polymerization reaction and obtain a toner base particle-dispersed solution 1.

Further, the toner base particle-dispersed solution 1 was adjusted by adding ion exchanged water so that the toner base particle concentration in the dispersion liquid became 20.0%.

<Production Example of Toner Base Particle-Dispersed Solutions 2 to 6, 8 to 21, 28, and 29>

Toner base particle-dispersed solutions 2 to 6, 8 to 21, 28, and 29 were produced in the same manner as in the production example of the toner base particle-dispersed solution 1, except that the resin A (R-1) was replaced with the resins A (R-2) to (R-6), (R-8) to (R-21), (R-23) and (R-24), respectively.

<Production Example of Toner Base Particle-Dispersed Solution 7>

A toner base particle-dispersed solution 7 was produced in the same manner as in the production example of the toner base particle-dispersed solution 1, except that the resin A (R-1) was replaced with the resin A (R-7), and the polyester (A-1) was replaced with the polyester (A-3).

<Production Example of Toner Base Particle-Dispersed Solution 22>

A toner base particle-dispersed solution 22 was produced in the same manner as in the production example of the toner base particle-dispersed solution 1, except that the polyester (A-1) was not used.

<Production Example of Toner Base Particle-Dispersed Solution 23>

A toner base particle-dispersed solution 23 was produced in the same manner as in the production example of the toner base particle-dispersed solution 1, except that the resin A (R-1) was not used.

<Production Example of Toner Base Particle-Dispersed Solution 24>

A toner base particle-dispersed solution 24 was produced in the same manner as in the production example of the toner base particle-dispersed solution 1, except that the resin A (R-1) was replaced with 3-aminopropyltrimethoxysilane.

<Production Example of Toner Base Particle-Dispersed Solution 25>

An aqueous medium 2 was prepared by mixing 660.0 parts of ion exchanged water and 25.0 parts of a 48.5% aqueous solution of sodium dodecyl diphenyl ether disulfonate and then stirring at 10,000 rpm by using T. K. HOMOMIXER.

The following materials were loaded into 500.0 parts of ethyl acetate, and dissolved at 100 rpm with a propeller type stirring device to prepare a solution.

| | |
|---|---|
| Styrene/butyl acrylate copolymer (Copolymerization mass ratio: 80/20) | 100.0 parts |
| Resin A (R-1) | 3.0 parts |
| Polyester (A-1) | 5.0 parts |
| Colorant (C. I. Pigment Blue 15:3) | 6.5 parts |
| Fisher-Tropsch wax (melting point: 78° C.) | 9.0 parts |

A total of 150.0 parts of the aqueous medium 2 was placed in a container and stirred using T. K. HOMOMIXER at a rotation speed of 12,000 rpm, and 100.0 parts of the solution was added thereto and mixed for 10 min to prepare an emulsified slurry.

Thereafter, 100.0 parts of the emulsified slurry was loaded into a flask equipped with a degassing pipe, a stirrer, and a thermometer, and the solvent was removed under reduced pressure at 30° C. for 12 h while stirring at 500 rpm, followed by aging at 45° C. for 4 h. Thus, a desolventized slurry was obtained.

After the desolventized slurry was filtered under reduced pressure, 300.0 parts of ion exchanged water was added to the obtained filter cake, followed by mixing with T. K. HOMOMIXER, re-dispersing (at 12,000 rpm for 10 min) and then filtering.

The obtained filter cake was dried in a dryer at 45° C. for 48 h, and sieved with a mesh having a mesh size of 75 μm to obtain toner base particles 25.

A total of 390.0 parts of ion exchanged water and 14.0 parts of sodium phosphate (dodecahydrate) (manufactured by Rasa Industries, Ltd.) were loaded into a container, and the temperature was maintained at 65° C. for 1.0 h while purging with nitrogen.

An aqueous solution of calcium chloride obtained by dissolving 9.2 parts of calcium chloride (dihydrate) in 10.0 parts of ion exchanged water was added all at once, while stirring at 12,000 rpm by using T. K. HOMOMIXER to prepare an aqueous medium including a dispersion stabilizer.

Further, 10% hydrochloric acid was added to the aqueous medium to adjust the pH to 6.0, whereby an aqueous medium 3 was obtained.

A total of 200.0 parts of the toner base particles 25 were charged into the aqueous medium 3, followed by dispersing for 15 min while rotating at 5,000 rpm and a temperature of 60° C. by using T. K. HOMOMIXER. The concentration of the toner base particles in the dispersion liquid was adjusted to 20.0% by adding ion exchanged water to obtain a toner base particle-dispersed solution 25.

<Production Example of Toner Base Particle-Dispersed Solution 26>

(Production Example of Resin Particle-Dispersed Solution)

The following materials were weighed, mixed and dissolved.

| | |
|---|---|
| Styrene | 82.6 parts |
| N-butyl acrylate | 9.2 parts |
| Acrylic acid | 1.3 parts |

-continued

| | |
|---|---|
| Resin A (R-1) | 3.0 parts |
| Hexanediol diacrylate | 0.4 parts |
| n-Lauryl mercaptan | 3.2 parts |

A 10% aqueous solution of NEOGEN RK (manufactured by Daiichi Kogyo Seiyaku Co., Ltd.) was added to the obtained solution and dispersed. An aqueous solution in which 0.15 part of potassium persulfate was dissolved in 10.0 parts of ion exchanged water was added while stirring slowly for another 10 min. After purging with nitrogen, emulsion polymerization was performed at a temperature of 70° C. for 6.0 h. After completion of the polymerization, the reaction solution was cooled to room temperature, and ion exchanged water was added to obtain a resin particle-dispersed solution having a solid fraction concentration of 12.5% and a volume-based median diameter of 0.2 μm.

(Production Example of Wax Particle-Dispersed Solution)

The following materials were weighed and mixed.

| | |
|---|---|
| Ester wax (melting point: 70° C.) | 100.0 parts |
| NEOGEN RK (manufactured by Daiichi Kogyo Seiyaku Co., Ltd.) | 15.0 parts |
| Ion exchanged water | 385.0 parts |

The above-mentioned materials were dispersed for 1 h using a wet jet mill JN100 (manufactured by Joko Corporation) to obtain a wax particle-dispersed solution. The solid fraction concentration of the wax in the wax particle-dispersed solution was 20.0%.

(Production Example of Colorant Particle-Dispersed Solution)

The following materials were weighed and mixed.

| | |
|---|---|
| Colorant (C. I. Pigment Blue 15:3) | 100.0 parts |
| NEOGEN RK (manufactured by Daiichi Kogyo Seiyaku Co., Ltd.) | 15.0 parts |
| Ion exchanged water | 885.0 parts |

The above materials were dispersed for 1 h using a wet jet mill JN100 (manufactured by Joko Corporation) to obtain a colorant particle-dispersed solution.

| | |
|---|---|
| Resin particle-dispersed solution | 160.0 parts |
| Wax particle-dispersed solution | 10.0 parts |
| Colorant particle-dispersed solution | 10.0 parts |
| Magnesium sulfate | 0.2 parts |

After dispersing the above materials using a homogenizer (ULTRA-TURRAX T50, manufactured by IKA), the mixture was heated to 65° C. while stirring.

After stirring at 65° C. for 1.0 h, observation with an optical microscope confirmed that aggregate particles having a number average particle diameter of 6.0 μm had been formed.

After adding 2.2 parts of NEOGEN RK (manufactured by Daiichi Kogyo Seiyaku Co., Ltd.) to the aggregate particles, the temperature was raised to 80° C. and stirring was performed for 2.0 h to obtain fused spherical toner base particles.

After cooling, filtration was performed, and the filtered solid matter was stirred and washed with 720.0 parts of ion exchanged water for 1.0 h. The solution including the toner base particles was filtered and dried using a vacuum dryer to obtain toner base particles 26.

A total of 390.0 parts of ion exchanged water and 14.0 parts of sodium phosphate (dodecahydrate) (manufactured by Rasa Industries, Ltd.) were loaded into a container, and the temperature was maintained at 65° C. for 1.0 h while purging with nitrogen.

An aqueous solution of calcium chloride obtained by dissolving 9.2 parts of calcium chloride (dihydrate) in 10.0 parts of ion exchanged water was added all at once, while stirring at 12,000 rpm by using T. K. HOMOMIXER to prepare an aqueous medium including a dispersion stabilizer.

Further, 10% hydrochloric acid was added to the aqueous medium to adjust the pH to 6.0, whereby an aqueous medium 4 was obtained.

A total of 200.0 parts of the toner base particles 26 were charged into the aqueous medium 4, followed by dispersing for 15 min while rotating at 5,000 rpm and a temperature of 60° C. by using T. K. HOMOMIXER. The concentration of the toner base particles in the dispersion liquid was adjusted to 20.0% by adding ion exchanged water to obtain a toner base particle-dispersed solution 26.

<Production Example of Toner Base Particle-Dispersed Solution 27>

The following materials were charged into a reaction container equipped with a cooling pipe, a stirrer, and a nitrogen introduction pipe.

| | |
|---|---|
| Terephthalic acid | 29.0 parts |
| Polyoxypropylene (2.2)-2,2-bis(4-hydroxyphenyl)propane | 80.0 parts |
| Titanium dihydroxybis(triethanolaminate) | 0.1 part |

Thereafter, heating was performed to 200° C. and a reaction was conducted for 9 h while introducing nitrogen and removing generated water. Further, 5.8 parts of trimellitic anhydride was added, followed by heating to 170° C. and reacting for 3 h to synthesize a polyester (A-11) as a binder resin.

Further,

| | |
|---|---|
| Low-density polyethylene (melting point: 100° C.) | 20.0 parts |
| Styrene | 64.0 parts |
| n-Butyl acrylate | 13.5 parts |
| Acrylonitrile | 2.5 parts |

were loaded into an autoclave, and after the atmosphere in the system was replaced with nitrogen, the temperature was raised and maintained at 180° C. while stirring.

A total of 50.0 parts of a 2.0% xylene solution of t-butyl hydroperoxide was continuously dropped into the system over 4.5 h. After cooling, the solvent was separated and removed, and a graft polymer in which a copolymer was grafted onto polyethylene was obtained.

| | |
|---|---|
| Polyester resin (A-11) | 100.0 parts |
| Resin A (R-1) | 3.0 parts |
| Paraffin wax (melting point: 75° C.) | 5.0 parts |
| Graft polymer | 5.0 parts |
| C. I. Pigment Blue 15:3 | 5.0 parts |

The above materials were thoroughly mixed with an FM mixer (Model FM-75, manufactured by Nippon Coke Industry Co., Ltd.), and then melt-kneaded with a twin-screw kneader (Model PCM-30, manufactured by Ikekai Iron Works Co., Ltd.) set at a temperature of 100° C.

The obtained kneaded material was cooled and coarsely pulverized to 1 mm or less with a hammer mill to obtain a coarsely pulverized material.

Next, the obtained coarsely pulverized product was finely pulverized to about 5 μm using a turbo mill (T-250: RSS rotor/SNB liner) manufactured by Turbo Kogyo Co., Ltd.

Then, the fine powder and the coarse powder were further cut using a multi-division classifier utilizing a Coanda effect to obtain toner base particles 27.

A total of 390.0 parts of ion exchanged water and 14.0 parts of sodium phosphate (dodecahydrate) (manufactured by Rasa Industries, Ltd.) were loaded into a container, and the temperature was maintained at 65° C. for 1.0 h while purging with nitrogen.

An aqueous solution of calcium chloride obtained by dissolving 9.2 parts of calcium chloride (dihydrate) in 10.0 parts of ion exchanged water was added all at once, while stirring at 12,000 rpm by using T. K. HOMOMIXER to prepare an aqueous medium including a dispersion stabilizer.

Further, 10% hydrochloric acid was added to the aqueous medium to adjust the pH to 6.0, whereby an aqueous medium 5 was obtained.

A total of 200.0 parts of the toner base particles 27 were charged into the aqueous medium 5, followed by dispersing for 15 min while rotating at 5,000 rpm and a temperature of 60° C. by using T. K. HOMOMIXER. The concentration of the toner base particles in the dispersion liquid was adjusted to 20.0% by adding ion exchanged water to obtain a toner base particle-dispersed solution 27.

<Production Example of Toner Base Particle-Dispersed Solution 28>

A toner base particle-dispersed solution 28 was produced in the same manner as in the production example of the toner base particle-dispersed solution 27 except that the resin A (R-1) was not used.

<Production Example of Toner Base Particle-Dispersed Solution 29>

A toner base particle-dispersed solution 29 was produced in the same manner as in the production example of the toner base particle-dispersed solution 27 except that the resin A (R-1) was replaced with a resin A (R-22) synthesized in the following manner.

[Synthesis of Resin A (R-22)]

| | |
|---|---|
| Toluene | 100.0 parts |
| Styrene | 70.0 parts |
| Butyl acrylate | 30.0 parts |
| 3-Mercaptopropylmethyldimethoxysilane | 1.8 parts |
| Azobisisobutyronitrile (AIBN) | 1.5 parts |

were placed in a four-necked flask and, after purging with nitrogen, polymerized at 80° C. for 8 h to obtain a toluene solution of a polymer. The toluene solution of the polymer was reprecipitated using n-hexane to obtain a resin A (R-22). The content of silicon atoms in the obtained resin A (R-22) was 0.21% by mass.

<Production Example of Toner Base Particle-Dispersed Solution 30>

A toner base particle-dispersed solution 30 was produced in the same manner as in the production example of the toner base particle-dispersed solution 17, except that the resin A (R-23) was used instead of the resin A (R-17).

<Production Example of Toner Base Particle-Dispersed Solution 31>

A toner base particle-dispersed solution 31 was produced in the same manner as in the production example of the toner base particle-dispersed solution 21 except that the resin A (R-24) was used instead of the resin A (R-21).

<Production Example of Organosilicon Compound Liquid 1>

| | |
|---|---|
| Ion exchange water | 90.0 parts |
| Methyltrimethoxysilane | 10.0 parts |

The above materials were weighed into a beaker, and the pH was adjusted to 4.5 with 1 mol/L hydrochloric acid. Thereafter, stirring was performed for 1 h while heating to 60° C. in a water bath to prepare an organosilicon compound liquid 1.

<Production Example of Organosilicon Compound Liquid 2>

An organosilicon compound liquid 2 was produced in the same manner as in the production example of the organosilicon compound liquid 1, except that 10.0 parts of methyltrimethoxysilane was replaced with a mixture of 8.5 parts of methyltriethoxysilane and 1.5 parts of tetraethoxysilane.

<Production Example of Organosilicon Compound Liquid 3>

An organosilicon compound liquid 3 was produced in the same manner as in the production example of the organosilicon compound liquid 1, except that 10.0 parts of methyltrimethoxysilane was replaced with a mixture of 9.0 parts of methyltrimethoxysilane and 1.0 parts of dimethoxydimethylsilane.

<Production Example of Organosilicon Compound Liquid 4>

An organosilicon compound liquid 4 was produced in the same manner as in the production example of the organosilicon compound liquid 1, except that 10.0 parts of methyltrimethoxysilane was replaced with a mixture of 9.5 parts of methyltrimethoxysilane and 0.5 part of propyltrimethoxysilane.

<Production Example of Organosilicon Compound Liquid 5>

An organosilicon compound liquid 5 was produced in the same manner as in the production example of the organosilicon compound liquid 4, except that propyltrimethoxysilane was replaced with hexyltrimethoxysilane.

<Production Example of Organosilicon Compound Liquid 6>

An organosilicon compound liquid 6 was produced in the same manner as in the production example of the organosilicon compound liquid 4, except that propyltrimethoxysilane was replaced with phenyltrimethoxysilane.

<Production Example of Organosilicon Compound Liquid 7>

An organosilicon compound liquid 7 was produced in the same manner as in the production example of the organosilicon compound liquid 1, except that methyltrimethoxysilane was replaced with tetramethoxysilane.

<Production Example of Organosilicon Compound Liquid 8>

An organosilicon compound liquid 8 was produced in the same manner as in the production example of the organosilicon compound liquid 1, except that methyltrimethoxysilane was replaced with dimethyldiethoxysilane.

<Production Example of Toner 1>

The following materials were weighed in a reaction container and mixed using a propeller stirring blade.

| | |
|---|---|
| Organosilicon compound liquid 1 | 20.0 parts |
| Toner base particle-dispersed solution 1 | 500.0 parts |

Next, the pH of the obtained liquid mixture was adjusted to 7.0, the temperature of the liquid mixture was adjusted to 50° C., and the temperature was maintained for 1 h while mixing using a propeller stirring blade.

Thereafter, the pH was adjusted to 9.5 with a 1 mol/L NaOH aqueous solution, and the temperature was maintained for 2 h at 50° C. while stirring.

The pH was adjusted to 1.5 with 1 mol/L hydrochloric acid, stirred for 1 h, filtered while washing with ion-exchanged water, and then dried to obtain toner particle 1.

Tetrahydrofuran (THF) insoluble matter of the toner particle 1 was measured by X-ray fluorescence measurement. As a result, the content of silicon atoms in the insoluble matter was 35% by mass.

Further, when the insoluble matter was measured by $^{29}$Si-NMR, the proportion of the peak of the structure represented by the formula (A) was 71%.

The obtained toner particle 1 was used as a toner 1.

<Production Examples of Toners 2 to 21, 28 to 31, and Comparative Toners 6 to 7>

Toners 2 to 21 and 28 to 31 and comparative toners 6 to 7 were produced in the same manner as in the production example of the toner 1, except that the toner base particle-dispersed solution 1 was replaced with the respective toner base particle-dispersed solution shown in Table 3. Table 3 below shows the physical properties of these toners.

<Production Example of Toner 22>

A toner 22 was obtained in the same manner as in the production example of the toner 1, except that the pH was adjusted to 9.5 and maintaining the temperature at 50° C. for 2 h while stirring was replaced with maintaining for 18 h. Table 3 below shows the physical properties of the toner.

Production Examples of Toners 23 to 27

Toners 23 to 27 were produced in the same manner as in the production example of toner 1, except that the organosilicon compound liquid 1 was replaced with organosilicon compound liquids 2 to 6, respectively. Table 3 below shows the physical properties of these toners.

<Production Example of Toner 32>

The pH of 500.0 parts of the toner base particle-dispersed solution 1 was adjusted to 11.5 with NaOH aqueous solution, the temperature thereof was heated to 60° C., and 20.0 parts of the organosilicon compound liquid 1 was added while stirring. After the addition, stirring was continued while maintaining the temperature at 60° C., thereby performing a condensation reaction for 2 hours.

Thereafter, the pH was adjusted to 1.5 with 1 mol/L hydrochloric acid, stirred for 1 h, filtered while washing with ion-exchanged water, and then dried to obtain toner particle 32.

Tetrahydrofuran (THF) insoluble matter of the toner particle 32 was measured by X-ray fluorescence measurement. As a result, the content of silicon atoms in the insoluble matter was 33% by mass.

Further, when the insoluble matter was measured by $^{29}$Si-NMR, the proportion of the peak of the structure represented by the formula (A) was 65%.

The obtained toner particle 32 was used as a toner 32.

<Production Example of Comparative Toner 1>

A comparative toner 1 was produced in the following manner according to Japanese Patent Application Publication No. 2013-120251.

The comparative toner 1 was produced in the same manner as in the production example of toner 1, except that the organosilicon compound liquid 1 was replaced with the organosilicon compound liquid 7, and the toner base particle-dispersed solution 1 was replaced with the toner base particle-dispersed solution 28. Table 3 below shows the physical properties of the toner.

<Production Example of Comparative Toner 2>

A comparative toner 2 was produced in the following manner according to Japanese Patent Application Publication No. H09-269611.

The comparative toner 2 was produced in the same manner as in the production example of toner 1, except that the organosilicon compound liquid 1 was replaced with the organosilicon compound liquid 8, and the toner base particle-dispersed solution 1 was replaced with the toner base particle-dispersed solution 29. Table 3 below shows the physical properties of the toner.

<Production Example of Comparative Toner 3>

A comparative toner 3 was produced in the following manner according to Japanese Patent Application Publication No. 2018-194837.

The comparative toner 3 was produced in the same manner as in the production example of toner 1, except that the toner base particle-dispersed solution 1 was replaced with the toner base particle-dispersed solution 23. Table 3 below shows the physical properties of the toner.

<Production Example of Comparative Toner 4>

A comparative toner 4 was produced in the following manner according to Japanese Patent Application Publication No. 2018-194837.

A total of 100 parts of the comparative toner 3 and 0.2 parts of hydrotalcite particles (trade name: DHT-4A, manufactured by Kyowa Chemical Industry Co., Ltd.) were loaded into SUPERMIXER PICCOLO (manufactured by Kawata Corporation), and mixing at 3,000 rpm was performed for 10 min. After the treatment, the sieving was performed with a mesh having an aperture of 150 μm to obtain a comparative toner 4. Table 3 below shows the physical properties of the toner.

<Production Example of Comparative Toner 5>

A comparative toner 5 was produced in the same manner as in the production example of toner 1, except that the toner base particle-dispersed solution 1 was replaced with the toner base particle-dispersed solution 24. Table 3 below shows the physical properties of the toner.

TABLE 3

| | Production conditions of toner base particle-dispersed solution | | Production of toner | | Physical properties of toner | |
|---|---|---|---|---|---|---|
| Toner number | Toner base particle-dispersed solution | Resin A | Organosilicon compound liquid | Organosilicon compound used to form organosilicon polymer | *2 | *3 |
| Toner 1 | 1 | R-1 | 1 | MTMS only | 35 | 71 |
| Toner 2 | 2 | R-2 | | | 33 | 70 |
| Toner 3 | 3 | R-3 | | | 34 | 70 |

TABLE 3-continued

| Toner number | Production conditions of toner base particle-dispersed solution: Toner base particle-dispersed solution | Production conditions of toner base particle-dispersed solution: Resin A | Production of toner: Organosilicon compound liquid | Production of toner: Organosilicon compound used to form organosilicon polymer | Physical properties of toner *2 | Physical properties of toner *3 |
|---|---|---|---|---|---|---|
| Toner 4 | 4 | R-4 | | | 35 | 68 |
| Toner 5 | 5 | R-5 | | | 33 | 39 |
| Toner 6 | 6 | R-6 | | | 34 | 70 |
| Toner 7 | 7 | R-7 | | | 38 | 71 |
| Toner 8 | 8 | R-8 | | | 35 | 72 |
| Toner 9 | 9 | R-9 | | | 34 | 70 |
| Toner 10 | 10 | R-10 | | | 34 | 74 |
| Toner 11 | 11 | R-11 | | | 37 | 75 |
| Toner 12 | 12 | R-12 | | | 36 | 75 |
| Toner 13 | 13 | R-13 | | | 35 | 69 |
| Toner 14 | 14 | R-14 | | | 33 | 67 |
| Toner 15 | 15 | R-15 | | | 35 | 69 |
| Toner 16 | 16 | R-16 | | | 36 | 73 |
| Toner 17 | 17 | R-17 | | | 34 | 74 |
| Toner 18 | 18 | R-18 | | | 33 | 71 |
| Toner 19 | 19 | R-19 | | | 35 | 72 |
| Toner 20 | 20 | R-20 | | | 35 | 71 |
| Toner 21 | 21 | R-21 | | | 35 | 70 |
| Toner 22 | 1 | R-1 | 1 | MTMS only | 39 | 89 |
| Toner 23 | | | 2 | MTES/T EOS = 85/15 (Ratio of number of parts) | 49 | 63 |
| Toner 24 | | | 3 | MTMS/DMDMS = 90/10 (Ratio of number of parts) | 32 | 51 |
| Toner 25 | | | 4 | MTMS/PrTMS = 95/5 (Ratio of number of parts) | 37 | 70 |
| Toner 26 | | | 5 | MTMS/HTMS = 95/5 (Ratio of number of parts) | 30 | 71 |
| Toner 27 | | | 6 | MTMS/PhTMS = 95/5 (Ratio of number of parts) | 36 | 70 |
| Toner 28 | 22 | R-1 | 1 | MTMS only | 34 | 71 |
| Toner 29 | 25 | | | | 33 | 71 |
| Toner 30 | 26 | | | | 35 | 73 |
| Toner 31 | 27 | | | | 35 | 72 |
| Toner 32 | 1 | R-1 | 1 | MTMS only | 33 | 65 |
| Comparative toner 1 | 28 | — | 7 | TMOS only | 97 | 10 |
| Comparative toner 2 | 29 | R-22 | 8 | DMDES only | 17 | 0 |
| Comparative toner 3 | 23 | — | 1 | MTMS only | 34 | 69 |
| Comparative toner 4 | | | | | | |
| Comparative toner 5 | 24 | 3-Aminopropyl trimethoxysilane | | | 35 | 31 |
| Comparative toner 6 | 30 | R-23 | | | 35 | 73 |
| Comparative toner 7 | 31 | R-24 | | | 34 | 72 |

*2: Silicon atom content (% by mass) in organosilicon polymer

*3: Proportion of the peak area of the structure represented by the formula (A) to the total peak area of the organosilicon polymer (%)

Abbreviations in Table 3 are as follows.

MTMS: methyltrimethoxysilane

MTES: methyltriethoxysilane

DMDMS: dimethyldimethoxysilane

DMDES: dimethyldiethoxysilane

TEOS: tetraethoxysilane

TMOS: tetramethoxysilane

PrTMS: propyltrimethoxysilane

HTMS: hexyltrimethoxysilane

PhTMS: phenyltrimethoxysilane

Examples 1 to 32, Comparative Examples 1 to 7

Methods for evaluating each of the toners 1 to 32 and the comparative toners 1 to 7 will be described below. Table 4 shows the evaluation results.

<Preparation for Toner Evaluation>

A modified version of a commercially available laser beam printer LBP7600C manufactured by Canon Inc. was used. The printer was modified by changing the rotation speed of the developing roller to 540 mm/sec by changing the evaluation machine main body and the software.

The modified printer was used to evaluate the toner charge quantity, the contamination of parts, and rise-up charging.

<Evaluation of Charge Quantity (Normal-Temperature and Normal-Humidity Environment)>

A total of 200 g of toner was loaded into a toner cartridge of LBP7600C. Then, the toner cartridge was allowed to stand for 24 h under an environment of normal temperature and normal humidity (25° C./50% RH; also referred to as N/N). The toner cartridge after 24 h under the environment was attached to the LBP7600C.

A total of 20 solid images were outputted. The machine was forcibly stopped during the output of the twentieth sheet, and the toner charge quantity on the developing roller immediately after passing through the regulating blade was measured. The measurement of the charge quantity on the developing roller was performed using a Faraday cage shown in the perspective view of the FIGURE. The inside (the right side in the FIGURE) was depressurized so that the toner on the developing roller was sucked, and a toner filter 33 was provided to collect the toner. In the FIGURE, the reference numeral 31 denotes a suction unit, and reference numeral 32 denotes a holder.

A charge quantity per unit mass (μC/g) was calculated from the mass M (g) of the collected toner and the charge Q (μC) directly measured by a coulomb meter, and a toner charge quantity (Q/M) was evaluated based on the following criteria. Table 4 shows the evaluation results.

A: less than −50 μC/g
B: −50 μC/g or more and less than −40 μC/g
C: −40 μC/g or more and less than −30 μC/g
D: −30 μC/g or more and less than −20 μC/g
E: −20 μC/g or more <Evaluation of Contamination of Parts (Method for Measuring Si Amount on Developing Roller)>

After completion of the evaluation of the charge quantity, 4,000 prints of images at a print percentage of 35.0% were printed out in the horizontal direction of A4 paper under the same environment.

After printing 4,000 prints, the developing roller was removed from the used cartridge, and the toner was removed with a blower. With respect to a portion centered on a point at 10 cm from one end of the developing roller toward the other end in the longitudinal direction, the surface of the developing roller was scraped with a cutter to obtain an area of 5 mm×5 mm and a thickness of 1 mm, and the developing roller was fixedly attached to a sample stage with a carbon tape. The sample stage to which the sample was attached was placed in a sample chamber for Pt ion sputtering (E-1045, manufactured by HITACHI), a discharge current was set to 15 mA, a discharge time was set to 20 seconds, a distance from the Pt target to the sample surface was set to 3 cm, and Pt was deposited at a degree of vacuum of 7.0 Pa. The obtained sample was observed with a scanning electron microscope (JSM-7800, manufactured by JEOL Ltd.). The observation conditions are as follows.

Observation mode: SEM
Detector: LED
Filter: 3
Irradiation current: 8
WD: 10.0 mm
Acceleration voltage: 5 kV The observation field of view was adjusted to 500 times, and EDS (NORAN System 7, manufactured by Thermo Fisher Scientific) analysis was performed. The conditions were set as follows, carbon, oxygen, silicon, and platinum were selected by setting the elements, and electron beam images were collected over the entire visual field.

Lifetime limit: 30 sec
Time constant: Ratel

Thereafter, the spectra were quantified to determine the proportion (atomic %) of each element of carbon, oxygen, silicon, and platinum. The value obtained by dividing the obtained proportion (atomic %) of silicon by the proportion (atomic %) of platinum was defined as the amount of Si on the developing roller in the visual field. The Si amount on the developing roller was measured for the three visual fields, and the average value was defined as the final Si amount (atomic %) on the developing roller and evaluated based on the following criteria. Table 4 shows the evaluation results.

A: less than 1.0 atomic %
B: 1.0 atomic % or more and less than 2.0 atomic %
C: 2.0 atomic % or more and less than 3.0 atomic %
D: 3.0 atomic % or more and less than 4.0 atomic %
E: 4.0 atomic % or more <Evaluation of Rise-Up of Charging (High-Temperature and High-Humidity Environment)>

A total of 200 g of toner was loaded into the toner cartridge of LBP7600C. Then, the toner cartridge was allowed to stand under a high-temperature and high-humidity environment (35° C./80% RH; also referred to as H/H) for 24 h. The toner cartridge after 24 h under the environment was attached to the LBP7600C.

First, after printing one black solid image, the toner charge quantity (Q/M) was measured by the same evaluation as in the evaluation of the charge quantity. The charge quantity at this time was defined as "initial toner charge quantity".

Next, 20 prints of a solid white image were printed, and the toner charge quantity (Q/M) was measured by the same evaluation as the evaluation of charge quantity. The charge quantity at this time was defined as "toner saturation charge quantity".

From the measurement result, the rise-up of charging was calculated by the following equation.

Charge rising performance (%)=(initial toner charge quantity)/(toner saturation charge quantity)×100

The charge rising performance obtained by the above equation was evaluated based on the following criteria. Table 4 shows the evaluation results.

A: charge rising performance is 90% or more
B: charge rising performance is 70% or more and less than 90%
C: charge rising performance is 50% or more and less than 70%
D: charge rising performance is 30% or more and less than 50%
E: charge rising performance is less than 30%

<Evaluation of Charge Retention Property (High-Temperature and High-Humidity Environment)>

A total of 0.01 g of the toner was weighed in an aluminum pan and charged to −600 V using a corona charger (trade name: KTB-20, manufactured by Kasuga Denki, Inc.). Subsequently, the change behavior of the surface potential was measured for 30 min in an H/H environment by using a surface electrometer (Model 347 manufactured by Trek Japan).

From the measurement result, a charge retention ratio was calculated by the following equation. The charge retention property was evaluated based on the charge retention ratio. Table 4 shows the evaluation results.

Charge retention ratio (%) after 30 min=(surface potential after 30 min/initial surface potential)×100

A: charge retention ratio is 90% or more
B: charge retention ratio is 70% or more and less than 90%
C: charge retention ratio is 50% or more and less than 70%
D: charge retention ratio is 30% or more and less than 50%
E: charge retention ratio is less than 30%

<Evaluation of Heat-Resistant Storage Stability>

About 10 g of toner was placed in a 100 mL polycup, allowed to stand at 50° C. (normal humidity) for 3 days, and evaluated visually. Table 4 shows the evaluation results.

A: no aggregates are observed
B: some aggregates are observed, but easily collapse
C: aggregates are observed, but easily collapse
D: aggregates are observed, but collapse when shaken
E: aggregates can be grasped and do not collapse easily

TABLE 4

| | | Charge quantity (N/N) | | Part contamination (N/N) | | Rise-up of charging (H/H) | | Charge retention property (H/H) | | Heat-resistant storage stability (50° C., 3 days) |
|---|---|---|---|---|---|---|---|---|---|---|
| | Toner number | μC/g | Rank A to E | Atomic % | Rank A to E | % | Rank A to E | % | Rank A to E | Rank A to E |
| Example 1 | Toner 1 | −58 | A | 0.6 | A | 95 | A | 94 | A | A |
| Example 2 | Toner 2 | −53 | A | 0.7 | A | 93 | A | 93 | A | A |
| Example 3 | Toner 3 | −55 | A | 0.8 | A | 92 | A | 94 | A | A |
| Example 4 | Toner 4 | −52 | A | 0.7 | A | 95 | A | 91 | A | A |
| Example 5 | Toner 5 | −58 | A | 0.7 | A | 96 | A | 94 | A | A |
| Example 6 | Toner 6 | −54 | A | 0.9 | A | 94 | A | 92 | A | A |
| Example 7 | Toner 7 | −55 | A | 0.8 | A | 93 | A | 94 | A | A |
| Example 8 | Toner 8 | −53 | A | 0.7 | A | 94 | A | 93 | A | A |
| Example 9 | Toner 9 | −55 | A | 0.6 | A | 93 | A | 92 | A | A |
| Example 10 | Toner 10 | −54 | A | 0.7 | A | 95 | A | 91 | A | A |
| Example 11 | Toner 11 | −55 | A | 0.3 | A | 94 | A | 96 | A | A |
| Example 12 | Toner 12 | −54 | A | 0.1 | A | 94 | A | 97 | A | A |
| Example 13 | Toner 13 | −49 | B | 1.3 | B | 84 | B | 82 | B | B |
| Example 14 | Toner 14 | −47 | B | 1.5 | B | 65 | C | 73 | B | B |
| Example 15 | Toner 15 | −43 | B | 1.7 | B | 58 | C | 60 | C | C |
| Example 16 | Toner 16 | −42 | B | 1.9 | B | 51 | C | 55 | C | C |
| Example 17 | Toner 17 | −41 | B | 1.8 | B | 75 | B | 75 | B | B |
| Example 18 | Toner 18 | −47 | B | 0.7 | A | 74 | B | 81 | B | B |
| Example 19 | Toner 19 | −49 | B | 0.7 | A | 75 | B | 80 | B | B |
| Example 20 | Toner 20 | −46 | B | 0.9 | A | 73 | B | 83 | B | B |
| Example 21 | Toner 21 | −38 | C | 0.8 | A | 76 | B | 78 | B | B |
| Example 22 | Toner 22 | −60 | A | 0.1 | A | 98 | A | 97 | A | B |
| Example 23 | Toner 23 | −42 | B | 0.8 | A | 72 | B | 78 | B | C |
| Example 24 | Toner 24 | −42 | B | 0.8 | A | 71 | B | 71 | B | C |
| Example 25 | Toner 25 | −48 | B | 0.7 | A | 87 | B | 73 | B | B |
| Example 26 | Toner 26 | −36 | C | 0.6 | A | 61 | C | 74 | B | C |
| Example 27 | Toner 27 | −37 | C | 0.7 | A | 67 | C | 73 | B | C |
| Example 28 | Toner 28 | −48 | B | 0.8 | A | 71 | B | 91 | A | A |
| Example 29 | Toner 29 | −55 | A | 0.7 | A | 93 | A | 92 | A | B |
| Example 30 | Toner 30 | −54 | A | 0.6 | A | 92 | A | 94 | A | B |
| Example 31 | Toner 31 | −56 | A | 0.7 | A | 94 | A | 91 | A | B |
| Example 32 | Toner 32 | −55 | A | 0.8 | A | 92 | A | 93 | A | A |
| Comparative Example 1 | Comparative toner 1 | −18 | E | 3.4 | D | 24 | E | 28 | E | C |
| Comparative Example 2 | Comparative toner 2 | −16 | E | 4.7 | E | 35 | D | 52 | C | E |
| Comparative Example 3 | Comparative toner 3 | −34 | C | 2.6 | C | 58 | C | 61 | C | C |
| Comparative Example 4 | Comparative toner 4 | −45 | B | 3.5 | D | 68 | C | 53 | C | C |
| Comparative Example 5 | Comparative toner 5 | −14 | E | 2.6 | C | 41 | D | 38 | D | E |
| Comparative Example 6 | Comparative toner 6 | −35 | C | 2.3 | C | 61 | C | 65 | C | C |
| Comparative Example 7 | Comparative toner 7 | −36 | C | 2.1 | C | 65 | C | 66 | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-083981, filed Apr. 25, 2019, Japanese Patent Application No. 2020-045709, filed Mar. 16, 2020 which are hereby incorporated by reference herein in their entireties.

What is claimed is:

1. A toner, comprising:

a toner particle, the toner particle includes comprising a toner core particle and an organosilicon polymer that coats a surface of the toner core particle, the organosilicon polymer having a structure represented by formula (A)

$$R^4—SiO_{3/2} \quad (A)$$

where $R^4$ independently represents an alkyl group having 1 to 6 carbon atoms or a phenyl group; and the toner core particle includes a resin A having an optionally substituted silyl group in a molecule thereof, a substituent of the substituted silyl group being at least one member selected from the group consisting of an alkyl group, an alkoxy group, a hydroxy group, a halogen atom and an aryl group having 6 or more carbon atoms, wherein a content of silicon atoms in resin A is 0.02 to 10.00% by mass, and a content of silicon atoms in the organosilicon polymer is 30 to 50% by mass.

2. The toner according to claim 1, wherein resin A has a structure represented by formula (1)

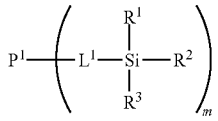

(1)

where $P^1$ represents a polymer segment, $L^1$ represents a single bond or a divalent linking group, and $R^1$ to $R^3$ independently represent a hydrogen atom, a halogen atom, an alkyl group, an alkoxy group, an aryl group having 6 or more carbon atoms or a hydroxy group, m represents a positive integer, with the proviso that when m is 2 or more, a plurality of $L^1$, a plurality of $R^1$, a plurality of $R^2$ and a plurality of $R^3$ may be the same or different.

3. The toner according to claim 2, wherein at least one of $R^1$ to $R^3$ represents said alkoxy or hydroxy group.

4. The toner according to claim 2, wherein $R^1$ to $R^3$ each independently represent said alkoxy or hydroxy group.

5. The toner according to claim 2, wherein $P^1$ represents a polyester segment or a styrene acrylic segment.

6. The toner according to claim 2, wherein $P^1$ represents a polyester segment.

7. The toner according to claim 1, wherein resin A has a weight average molecular weight of 3,000 to 100,000.

8. The toner according to claim 1, where a proportion of a peak area of the structure represented by formula (A) to a total peak area of the organosilicon polymer is 30 to 100% in $^{29}$Si-NMR measurement of a tetrahydrofuran-insoluble matter of the toner particle.

9. The toner according to claim 8, wherein the proportion of the peak area of the structure represented by formula (A) to the total peak area of the organosilicon polymer is 50 to 90%.

10. The toner according to claim 1, wherein $R^4$ represents an alkyl group having from 1 to 3 carbon atoms.

* * * * *